US005641619A

United States Patent [19]

Haraguchi et al.

[11] Patent Number: 5,641,619

[45] Date of Patent: Jun. 24, 1997

[54] METHOD FOR PRODUCING SILVER HALIDE EMULSION DOPED WITH A NON-LABILE SELENIUM COMPOUND

[75] Inventors: Nobuyuki Haraguchi; Hideo Ikeda; Hiroyuki Mifune; Tetsuro Kojima, all of Kanagawa, Japan

[73] Assignee: Fuji Photo Film Co., Ltd., Kanagawa, Japan

[21] Appl. No.: 547,132

[22] Filed: Oct. 24, 1995

[30] Foreign Application Priority Data

Oct. 24, 1994 [JP] Japan ..... 6-282435

[51] Int. Cl.[6] ..... G03C 1/015; G03C 1/09

[52] U.S. Cl. ..... 430/569; 430/603

[58] Field of Search ..... 430/569, 603

[56] References Cited

U.S. PATENT DOCUMENTS 5,164,292 11/1992 Johnson et al. ..... 430/569

5,166,045 11/1992 Wu ..... 430/569

*Primary Examiner*—Mark F. Huff

*Attorney, Agent, or Firm*—Sughrue, Mion, Zinn, Macpeak & Seas

[57] ABSTRACT

A method for producing a silver halide emulsion, said method comprising: adding silver nitrate to a halogen compound to form an emulsion grain; and doping a non-labile selenium compound in an amount, in terms of selenium added, of from $1.0\times10^{-8}$ to $1.0\times10^{-6}$ mol per a unit surface area of 1 $m^2$ of said emulsion grain, at the time when from 10 to 49% of the total silver amount used for the formation of said emulsion grain is added.

8 Claims, No Drawings

METHOD FOR PRODUCING SILVER HALIDE EMULSION DOPED WITH A NON-LABILE SELENIUM COMPOUND

FIELD OF THE INVENTION

The present invention relates to a method for producing a high-sensitive silver halide photographic emulsion having excellent incubation durability.

BACKGROUND OF THE INVENTION

It is well known to conduct chemical sensitization using a labile compound such as sulfur compounds, selenium compounds, tellurium compounds, gold compounds, platinum compounds or palladium compounds, or a combination of these compounds for producing a high-sensitive silver halide photographic emulsion and a high-sensitive photographic material.

U.S. Pat. No. 3,772,031 describes a method for obtaining a high-sensitive emulsion by uniformly doping an ion of a chalcogen group inside a grain and JP-B-46-4553 (the term "JP-B" as used herein means an "examined Japanese patent publication") describes a method for obtaining a high-sensitive photographic emulsion by unstabilizing a non-labile selenium compound with a reducing agent and effectively controlling the chemical sensitization of grain.

As a means for achieving higher sensitivity, U.S. Pat. Nos. 5,166,045 and 5,164,292 describe a method for obtaining a high-sensitive photographic emulsion by doping the above-described non-labile selenium compound in an amount, in terms of selenium added, of from $0.05\times10^{-8}$ to $0.62\times10^{-8}$ mol per the unit surface area (1 $m^2$) of the emulsion grain after, in the former, from 65 to 90% (U.S. Pat. No. 5,166,045) or 50% or more (U.S. Pat. No. 5,164,292) of the total silver amount for use in the emulsion grain formation is added, and then subjecting the doped grain to chemical sensitization in the presence of a nucleophilic agent.

It is possible to prepare a photographic emulsion having high sensitivity to a certain degree by the chemical sensitization method using the above-described selenium compound. However, this technique is not yet sufficient to prepare a higher sensitive photographic emulsion or photographic material and a further improvement in techniques has been demanded.

The photographic emulsion prepared using the above-described selenium compound and the photographic material using the same are usually inferior in the incubation durability, and therefore an improvement in this point has also been demanded.

The present inventors have made investigations on a method for achieving high sensitivity using a selenium compound as disclosed in the above-described publications. As a result, an emulsion having high sensitivity as compared with that obtained by gold-sulfur sensitization which has hitherto been employed and a photographic material using the same have been obtained. However, further investigations and improvements are needed to achieve sensitivity on an intended level without deteriorating the incubation durability.

SUMMARY OF THE INVENTION

An object of the present invention is to provide a method for producing a high-sensitive silver halide photographic emulsion that is low in fog level and excellent in incubation durability.

Other objects and effects of the present invention will be apparent from the following description.

The present inventors have made further investigations to obtain a photographic emulsion having high sensitivity and, at the same time, incubation durability. As a result, it has been found that by setting earlier the addition stage of the above-described non-labile selenium compound than that disclosed in U.S. Pat. Nos. 5,166,045 and 5,164,292, i.e., the compound is added before 49% of the total silver amount used for the emulsion grain formation is added, and also by increasing the addition amount more than the amount disclosed in the above-described publications, i.e., the compound is added in an amount of from $1.0\times10^{-8}$ to $1.0\times10^{-6}$ mol per the unit surface area (1 $m^2$) of the emulsion grain, higher sensitivity can be achieved and a photographic emulsion or photographic material prepared according to this method can have excellent incubation durability.

Further, they have also found that still higher sensitivity can be obtained by adding a compound represented by formula (I) and that a silver halide emulsion, and that photographic material having still higher sensitivity, small reciprocity law failure and excellent incubation durability can be prepared by doping thiocyanate ion or iridium before the completion of grain formation. Thus, the present invention has been accomplished based on these findings.

The present invention relates to a method for producing a silver halide emulsion, the method comprising:

adding silver nitrate solution to a halogen salt solution to form an emulsion of silver halide grains; and doping a non-labile selenium compound in an amount, in terms of selenium added, of from $1.0\times10^{-8}$ to $1.0\times10^{-6}$ mol per a unit surface area of 1 $m^2$ of the emulsion grain, at the time when from 10 to 49% of the total silver amount used for the formation of the emulsion grain is added.

In a preferred embodiment of the method of the present invention, the silver halide emulsion contains a nucleophilic agent represented by formula (I) in an amount of from $1.0\times10^{-8}$ to $5.0\times10^{-6}$ mol per a unit surface area of 1 $m^2$ of the emulsion grain:

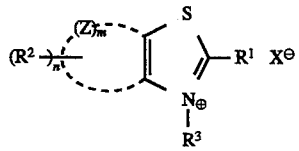

(I)

wherein $R^1$ represents a hydrogen atom or an alkyl group having from 1 to 6 carbon atoms which may be substituted, m represents 0 or 1, when m is 1, Z represents a condensed benzene ring and $R^2$ substitutes to the ring and when m is 0, $R^2$ substitutes to the 4- or 5-position of the thiazolium ring, $R^2$ represents a hydrogen atom, an alkyl, alkenyl, alkynyl or alkoxy group having from 1 to 6 carbon atoms which may be substituted or an electron-withdrawing group, when n is 2 or more, a plurality of $R^2$ groups may be the same or different or the $R^2$ groups may be combined with each other to form a condensed ring, $R^3$ represents a hydrogen atom or an alkyl, alkenyl, alkynyl or aralkyl group which may be substituted, $X^-$ represents an anion, and n represents an integer of from 0 to 3, and said nucleophilic agent may be a compound where the thiazolium ring of formula (I) is opened.

In another preferred embodiment of the method of the present invention, thiocyanate ion is doped before the completion of the formation of the emulsion grain.

In another preferred embodiment of the present invention, iridium is doped in an amount from $3.4\times10^{-10}$ to $1.0\times10^{-9}$ mol per a unit surface area of 1 $m^2$ of the emulsion grain, at the time when from 10 to 50% of the total silver amount used in the formation of the emulsion grain is added.

In a still another preferred embodiment of the method of the present invention, the emulsion grain comprises a tabular grain having an aspect ratio of from 2 to 100.

DETAILED DESCRIPTION OF THE INVENTION

The method according to the present invention may be based on conventional methods for producing a silver halide emulsion. Examples of such conventional methods include those described in, e.g., P. Glafkides, *Chimie et Physiue Photoghraphique*, Paul Montel, 1967; G. F. Duffin, *Photographic Emulsion Chemistry*, Focal Press, 1966; and V. L. Zelikman et al. *Making and Coating Photographic Emulsion*, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

The size of the silver halide grain of the present invention is expressed by a projected area size. The projected area size as used herein means a diameter of a circle having an area equal to the projected area of a grain.

The size of the silver halide grain of the present invention is preferably from 0.1 to 5.0 μm, more preferably from 0.2 to 2.0 μm, particularly preferably from 0.2 to 0.7 μm.

There is no particular limitation on the halogen composition of the silver halide emulsion of the present invention, but silver iodobromide is particularly preferred.

The average silver iodide content of the silver halide emulsion of the present invention is preferably less than 6 mol %, more preferably 5 mol % or less, still more preferably 4.5 mol % or less.

Although the relative standard deviation of iodide distribution among grains of the silver halide emulsion of the present invention is not particularly restricted, it is preferably 50% or less, more preferably 40% or less.

The silver iodide content of individual emulsion grains can be measured by analyzing the composition every one grain using, for example, an X-ray microanalyzer. The term "the relative standard deviation of silver iodide content of individual grains" as used herein means a value obtained by dividing the standard deviation of silver iodide content resulting from determination on the silver iodide content using, for example, an X-ray microanalyzer for at least 100 emulsion grains, by an average silver iodide content and multiplying the result by 100. The method for determining the silver iodide content of individual emulsion grains is specifically described, for example, in European Patent 147,868A.

If the relative standard deviation of silver iodide content of individual grains is too large, the individual grains differ from each other in the optimum point of chemical sensitization to render it impossible to extract capability of all grains and the relative standard deviation of dislocation line number among grains also tends to be large.

An interrelation may be present or absent between the silver iodide content Yi (mol %) of individual grains and the sphere-corresponding diameter Xi (μm) of each grain, but it is preferred that there is no interrelation therebetween.

The structure regarding the halogen composition of the grain of the present invention can be verified, for example, by using in combination an X-ray diffraction method, an EPMA (sometimes called XMA) method (a method for detecting the silver halide composition by scanning a silver halide gram by electron beams) and an ESCA (sometimes called XPS) method (a method for separating photoelectrons emitted from the grain surface upon irradiation of an X ray).

The silver halide grain of the present invention may be either a fine grain having a grain size of about 0.1 μm or less or a large-sized grain having a projected area diameter up to about 10 μm. Either an emulsion having a narrow size distribution or an emulsion having a broad size distribution may be used but a monodisperse emulsion is preferred because good granularity can be achieved. The silver halide grain for use in the present invention may have any shape but a tabular grain is the most preferred.

The aspect ratio means a ratio of a projected area diameter to the thickness, and the thickness as used herein means a shortest length passing the center of gravity of a grain. With respect to the tabular grain, the aspect ratio is preferably from 2 to 100, more preferably from 3 to 20.

A representative example of the monodisperse emulsion is an emulsion in which 95 wt % of grains have a size falling within the range of the average diameter ±40%. An emulsion in which at least 95 wt % or at least 95% by grain number of silver halide grains have a size falling within the range of the average grain diameter ±25% is preferably used in the present invention.

A polyvalent metal such as iridium, rhodium or lead may be added to the silver halide emulsion of the present invention during grain formation.

For example, iridium may be added to improve the reciprocity law failure property. The addition amount thereof differs depending upon the kind and the size of the silver halide grain and it is preferably from $3.4\times10^{-10}$ to $1.0\times10^{-9}$ mol, more preferably from $5.2\times10^{-10}$ to $1.0\times10^{-9}$ mol, per the unit surface area (1 $m^2$) of the silver halide grain.

The addition of iridium may be made when the amount of the silver added reached preferably from 10 to 50%, more preferably from 20 to 30%, of the total silver amount for use in grain formation.

The silver halide emulsion of the present invention may be subjected to chemical sensitization. The chemical sensitization may be conducted, for example, using an active gelatin as described in T. H. James, *The Theory of the*

*Photographic Process,* 4th ed., pp. 67–77, Macmillan (1977), or using sulfur, selenium, tellurium, gold, platinum, iridium or a combination of a plurality of these sensitizers at a pAg of from 5 to 10, a pH of from 5 to 8 and a temperature of from 30° to 80° C. as described in *Research Disclosure*, Vol. 120, 12008 (April, 1974), *Research Disclosure*, Vol. 34, 13452 (June, 1975), U.S. Pat. Nos. 2,642,361, 3,297,446, 3,772,031, 3,857,711, 3,901,714, 4,266,018 and 3,904,415 and British Patent 1,315,755. The chemical sensitization is optimally conducted in the presence of a gold compound and a thiocyanate compound. It may also be conducted in the presence, for example, of a sulfur-containing compound or a sulfur-containing sodium thiosulfate, thiourea-based compound or rhodanine-based compound described in U.S. Pat. Nos. 3,857,711, 4,266,018 and 4,054,457. The chemical sensitization aid includes compounds known to inhibit fogging and to increase sensitivity during chemical sensitization, such as azaindene, azapyridazine and azapyrimidine. Examples of the modifier for the chemical sensitization aid are described in U.S. Pat. No. 2,131,038, 3,411,914 and 3,554,757, JP-A-58-126526 (the term "JP-A" as used herein means an "unexamined published Japanese patent application") and Duffin, *Photographic Emulsion Chemistry,* pp. 138–143. In addition to or in place of chemical sensitization, a reduction sensitization may be conducted using, for example, hydrogen as described in U.S. Pat. Nos. 3,891,446 and 3,984,249. The reduction sensitization may also be conducted using a reducing agent such as stannous chloride, thiourea dioxide or polyamine described in U.S. Pat. Nos. 2,518,698, 2,743,182 and 2,743,183 or by a low pAg (for example, less than 5) processing and/or a high pH (for example, more than 8) processing. Further, the color sensitization property may be improved by the chemical sensitization described in U.S. Pat. Nos. 3,917,485 and 3,966,476.

The silver halide emulsion of the present invention may be doped by a thiocyanate ion during grain formation. The addition amount of the thiocyanate ion is not particularly limited, however, it is relatively preferably from $1\times10^{-2}$ to $1\times10^{-1}$ mol per mol of silver.

The addition of the thiocyanate is preferably conducted before the completion of silver halide grain formation, more preferably before doping of the non-labile selenium compound.

A sensitization method using an oxidizing agent described in JP-A-61-3134 or JP-A-61-3136 may also be used.

The emulsion of the present invention is preferably subjected to chemical sensitization using a selenium compound (selenium sensitization).

The selenium sensitization may be applied to the silver halide emulsion of the present invention according to a conventionally known method. More specifically, it is commonly conducted by adding a labile selenium compound and/or a non-labile selenium compound and stirring the emulsion at a high temperature, preferably at 40° C. or higher, for a predetermined time period. The selenium sensitization is preferably conducted using a labile selenium sensitizer described in JP-B-44-15748. Specific examples of the labile selenium sensitizer include aliphatic isoselenocyanates such as allylisoselenocyanate, selenoureas, selenoketones, selenoamides, selenocarboxylic acids or esters and selenophosphates. Particularly preferred labile selenium compounds are described below.

I. Colloidal metal selenium

II. Organic selenium compound (selenium atom is double-bonded to the carbon atom of an organic compound through a covalent bond):

a. isoselenocyanates
  e.g., aliphatic isoselenocyanate such as allylisoselenocyanate
b. selenoureas (inclusive of enol form)
  e.g., aliphatic selenourea such as methyl, ethyl, propyl, isopropyl, butyl, hexyl, octyl, dioctyl, tetramethyl, N-(β-carboxyethyl)-N',N'-dimethyl, N,N-dimethyl, diethyl and dimethyl; aromatic selenourea having one or more aromatic group such as phenyl and tolyl; heterocyclic selenourea having a heterocyclic group such as pyridyl and benzothiazolyl
c. selenoketones
  e.g., selenoacetone, selenoacetophenone, selenoketone with the alkyl group being bonded to —C(=Se)—, selenobenzophenone
d. selenoamides
  e.g., selenoamide
e. selenocarboxylic acids and esters
  e.g., 2-selenopropionic acid, 3-selenolactic acid, methyl-3-selenobutyrate III. Others a. selenides
  e.g., diethyl selenide, diethyl diselenide, triphenylphosphine selenide
b. selenophosphates
  e.g., tri-p-tolylselenophosphate, tri-n-butylselenophosphate Preferred labile selenium compounds are described above, but the present invention is by no means limited to these. A person skilled in the art generally understands that the labile selenium compound as a sensitizer for a photographic emulsion carries selenium in the organic moiety of the selenium sensitizer molecule and plays no other role than to let the selenium be present in a labile state in the emulsion and that the structure of the compound is not so important as long as the selenium is labile. In the present invention, the labile selenium compound under such a wide conception is advantageously used.

Selenium sensitization using non-labile selenium sensitizers described in JP-B-46-4553, JP-B-52-34492 and JP-B-52-34491 may also be used. Examples of the non-labile selenium compound include selenious acid, potassium selenocyanide, a selenazole, a quaternary ammonium salt of a selenazole, diaryl selenide, diaryl diselenide, 2-thioselenazolidinedione, 2-selenooxazolidinethione and derivatives of these.

Non-labile selenium sensitizers and thioselenazolidinedione compounds described in JP-B-52-38408 are also effective.

The selenium sensitizer is dissolved in water or an organic solvent such as methanol or ethanol as a sole solvent or a mixed solvent and added at the chemical sensitization. It is preferably added before the initiation of chemical sensitization other than selenium sensitization. The selenium sensitizer used is not limited to one kind but two or more kinds of the above-described selenium sensitizers may be used in combination. A combination use of a labile selenium compound and a non-labile selenium compound is preferred.

The addition amount of the selenium sensitizer used in the present invention varies depending on the activity of the selenium sensitizer used, the kind and the size of silver halide, and the temperature and the time for ripening. It is preferably $1\times10^{-8}$ mol or more, more preferably from $1\times10^{-7}$ mol to $5\times10^{-5}$ mol, per mol of silver halide. The temperature in chemical ripening using a selenium sensitizer is preferably 45° C. or higher, more preferably from 50° to 80° C.

The pAg can be freely selected in using a selenium sensitizer. It is preferably 7.5 or more, more preferably 8.0 or more. The pH can also be freely selected but it is preferably 7.5 or less, more preferably 6.8 or less. These preferred conditions may be used individually but preferably used in combination.

The selenium sensitization of the present invention is more effective when it is conducted in the presence of a silver halide solvent.

Examples of the silver halide solvent which can be used in the present invention include (a) organic thioethers described in U.S. Pat. Nos. 3,271,157, 3,531,289 and 3,574,628, JP-A-54-1019 and JP-A-54-158917, (b) thiourea derivatives described in JP-A-53-82408, JP-A-55-77737 and JP-A-55-2982, (c) silver halide solvents having a thiocarbonyl group interposed between the oxygen or sulfur atom and the nitrogen atom described in JP-A-53-144319, (d) imidazoles described in JP-A-54-100717, (e) sulfites and (f) thiocyanates.

Particularly preferred solvents are thiocyanate and tetramethylthiourea. The amount of the solvent used varies depending on the kind thereof, however, for example, in the case of a thiocyanate, it is preferably from $1\times10^{-4}$ to $1\times10^{-2}$ mol per mol of silver halide.

In chemical sensitization of the silver halide grain of the present invention, it is preferred to also conduct one or both of sulfur sensitization and gold sensitization in addition to selenium sensitization.

The sulfur sensitization is usually carried out by adding a sulfur sensitizer and stirring the emulsion at a high temperature, preferably 40° C. or higher, for a predetermined time period.

The gold sensitization is usually carried out by adding a gold sensitizer and stirring the emulsion at a high temperature, preferably 40° C. or higher, for a predetermined time period.

A known sulfur sensitizer may be used in the above-described sulfur sensitization. Examples thereof include thiosulfate, allylthiocarbamidethiourea, allylisocyanate, cystine, p-toluenethiosulfonate and rhodanine. In addition, sulfur sensitizers described in U.S. Pat. Nos. 1,574,944, 2,410,689, 2,278,947, 2,728,668, 3,501,313 and 3,656,955, German Patent 1,422,869, JP-B-56-24937 and JP-A-55-45016 may also be used.

The addition amount of the sulfur sensitizer may be small if the sensitivity of the emulsion can be effectively increased. The addition amount varies over a wide range under various conditions such as the pH, the temperature and the size of silver halide grain, but it is preferably from $1\times10^{-7}$ to $5\times10^{-5}$ mol per mol of silver halide.

The gold sensitizer used for gold sensitization of the present invention may have a gold oxidation number either of +1 valence or +3 valence and a gold compound commonly used as a gold sensitizer may be used. Representative examples thereof include chloroaurate, potassium chloroaurate, auric trichloride, potassium auric thiocyanate, potassium iodoaurate, tetracyanoauric acid, ammonium aurothiocyanate and pyridyltrichlorogold.

The addition amount of the gold sensitizer may vary depending upon various conditions but, in general, it is preferably from $1\times10^{-7}$ to $5\times10^{-5}$ mol per mol of silver halide.

In conducting chemical ripening, the addition time and the addition order of the silver halide solvent, the selenium sensitizer, the sulfur sensitizer and the gold sensitizer are not limited. For example, the these compounds may be (1) added simultaneously at the initial stage of chemical ripening, (2) added simultaneously during the proceeding of chemical ripening, or (3) added separately at different times. It is preferred that these compounds are (1) added simultaneously at the initial stage of chemical repening. The above-described compounds each may be added after dissolving it in water or an organic solvent capable of mixing with water, for example, a single solution or a mixed solution of methanol, ethanol and acetone.

The emulsion of the present invention may be subjected to chemical sensitization on the surface or over from the surface to an arbitrary position but it is preferred to apply chemical sensitization on the surface thereof. A method described in JP-A-63-264740 may be used for effecting chemical sensitization inside the emulsion.

The silver halide emulsion may be subjected to reduction sensitization during grain formation or chemical sensitization.

The silver halide emulsion is preferably subjected to reduction sensitization during grain formation thereof, which basically means to conduct the reduction sensitization during nucleation, ripening or growing. The reduction sensitization may be conducted at any stage of nucleation, physical ripening and growing as an initial stage of grain formation. Most preferably, the reduction sensitization is conducted during growing of the silver halide grain. The term "during growing" as used herein includes the method where the reduction sensitization is conducted in the state that the silver halide grain is growing by physical ripening or by the addition of a water-soluble silver salt and a water-soluble alkali halide and also a method where the reduction sensitization is conducted on the way of growing while once stopping growing and then the growing is driven to further proceed.

The above-described reduction sensitization may be conducted by any method selected from a method where a known reducing agent is added to a silver halide emulsion, a method where the emulsion is grown or ripened in a low pAg atmosphere at a pAg of from 1 to 7 called silver ripening and a method where the emulsion is grown or ripened in a high pH atmosphere at a pH of from 8 to 11 called high pH ripening. Two or more of these methods may be used in combination.

The method comprising addition of a reducing agent is preferred because the reduction sensitization level can be delicately controlled.

Examples of known reduction sensitizers include a stannous salt, amines and polyamines, a hydrazine derivative, a formamidinesulfinic acid, a silane compound and a borane compound. In the present invention, a reduction sensitizer selected from these known compounds may be used. Two or more compounds may also be used in combination. Preferred examples of the reduction sensitizer include a stannous salt, a thiourea dioxide, a dimethylamineborane, an ascorbic acid and an ascorbic acid derivative. The addition amount of the reduction sensitizer depends on the conditions for producing an emulsion and thus, the addition amount must be appropriately selected according to the case, but it is suitably from $10^{-8}$ to $10^{-3}$ mol per mol of silver halide.

The reduction sensitizer may be dissolved in water or a solvent such as alcohol, glycol, ketone, ester or amide and then added to the emulsion during grain formation. Although it may be previously added to the reaction vessel, it is preferred to add the reduction sensitization at an appropriate time of grain formation. The reduction sensitizer may also be previously added to an aqueous solution of a water-soluble silver salt or of a water-soluble alkali halide and the grain formation may be conducted using the aqueous solution. Further, it is also preferred to add the reduction sensitizer solution intermittently several times or continuously as the grain formation proceeds.

As the non-labile selenium compound to be doped during emulsion grain formation of the present invention, the compounds described in JP-B-46-4553, JP-B-52-34492 and JP-B-52-34491 may be used. Examples of the non-labile selenium compound include a selenious acid; selenocyanates such as potassium selenocyanate and sodium selenocyanate; heterocyclic rings such as selenazole and selenadiazole; a quaternary salt of selenazoles; seleno ethers and diselenides such as diaryl selenide, diaryl diselenide, dialkyl selenide and dialkyl diselenide; 2-selenazolidinedione, 2-selenooxazolidinethione and derivatives of these. Among these, a selenocyanic acid compound such as potassium selenocyanate is most preferred.

The non-labile selenium compound is preferably added during grain formation of silver halide and in particular, it is preferably added before from 10 to 49%, more preferably from 30 to 49% of the total silver amount for use in the silver halide grain formation is added.

The non-labile selenium compound is preferably added in an amount, in terms of selenium added, of from $1.0\times10^{-8}$ to $1.0\times10^{-6}$ mol, more preferably from $1.0\times10^{-8}$ to $1.0\times10^{-7}$ mol the unit surface area (1 $m^2$) of the emulsion grain.

The nucleophilic agent for use in the present invention includes known compounds described in J. M. Harris et al *Advances in Chemistry Series, "Nucleophilicity"*, (1987), A. Streitwieser et al, *Introduction to Organic Chemistry*, Macmillan, New York (1976) and *J. Am. Chem. Soc.*, 90, 319 (1968).

Preferred examples of the nucleophilic agent for use in the present invention include sulfites such as sodium sulfite, potassium sulfite, ammonium sulfite and sodium hydrogensulfite; mercaptos such as thiosalicylic acid, thioglycolic acid, cistein, thiolactic acid and 2-mercaptobenzothiazole; phosphines such as triphenylphosphine and tributylphosphine; thiazolium salts showing a nucleophilic property upon ring cleavage, such as 3-methylbenzothiazolium iodide, 3-allylthiazoium bromide, 2-hydroxymethyl-3-ethylbenzothiazolium iodide, 2,3-(2-propenyl) benzothiazolium bromide and 3-(2-propargyl) benzothiazolium bromide; sulfinic acids such as sodium ethanesulfinate and sodium benzenesulfinate; thiosulfonic acids such as methanethiosulfonic acid and benzenethiosulfonic acid; hydrazines such as methylhydrazine and phenylhydrazine; amines such as ethanolamine and ethylenediamine; hydroxamic acids; and hydroxylamines such as N-methylhydroxyamine. Among these, preferred are thiazolium salts and mercaptos and, in particular, thiazolium salts represented by formula (I) is preferred.

The compound represented by formula (I) of the present invention is described below in detail.

Examples of the alkyl group having from 1 to 6 carbon atoms represented by $R^1$ include a methyl group and a propyl group.

Examples of the alkyl, alkenyl, alkynyl or alkoxy group having from 1 to 6 carbon atoms represented by $R^2$ include a methyl group, an ethyl group, a hexyl group, an allyl group, a propargyl group and a methoxy group.

Examples of the group which can substitute to $R^1$ or $R^2$ include a hydroxyl group, a carboxyl group, an amino group, a carbamoyl group, a sulfamoyl group and a halogen atom.

Examples of the electron-withdrawing group represented by $R^2$ include a halogen atom (e.g., Cl), a carboxyl group, a trifluoromethyl group, a cyano group, a nitro group a sulfo group of $—SO_2R^4$, an aminosulfonyl group of $—SO_2NHR^4$ and an acyl group of $—COR^4$ (wherein $R^4$ represents a hydrogen atom, a lower alkyl group or a phenyl group).

Examples of the compound where a plurality of $R^2$ groups are combined to form a condensed ring include those where the compound represented by formula (I) is naphthothiazonium.

Examples of the alkyl, alkenyl, alkynyl or aralkyl group represented by $R^3$ include a methyl group, a propyl group, a butyl group, a hexyl group, an allyl group, a propargyl group and a benzyl group.

Examples of the group which substitutes to the above-described groups include a sulfon group, a hydroxyl group, an amino group which may be substituted, a halogen atom, $—SO_2R^4$, $—SO_2NHR^4$, $—NHSO_2R^4$, $—CONHR^4$, $—NHCOR^4$, $—COR^4$, $—COOR^4$ (wherein $R^4$ has the same meaning as defined above) and a heterocyclic group (e.g., pyrimidine, pyridine, furan).

Examples of the anion represented by $X^-$ include a halide ion, a nitrate ion, a phosphate ion, a chlorate ion and an anion derived from an organic acid, such as formate ion, acetate ion and p-toluenesulfonate (PTS) ion. However, when $R^1$, $R^2$ or $R^3$ has an anionic group, $X^-$ is not required.

The thiazolium ring of the compound represented by formula (I) may be cleaved and may have an open-ring form. In the compound represented by formula (I), preferably $R^1$ is a hydrogen atom, more preferably, m is 1 and $R^1$ is a hydrogen atom.

Specific examples of the compound represented by formula (I) include the following compounds.

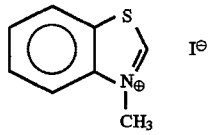

I-1

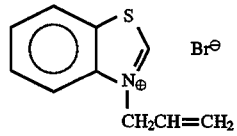

I-2

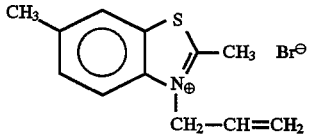

I-3

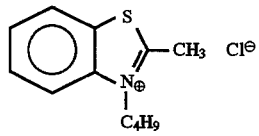

I-4

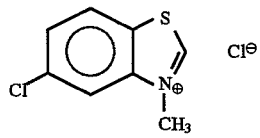

I-5

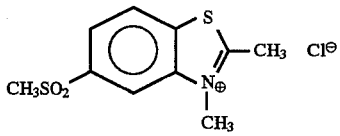

I-6

-continued

I-7

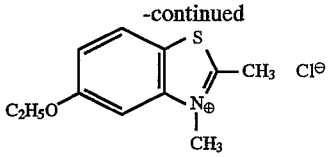

I-8

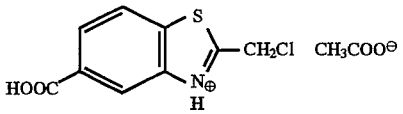

I-9

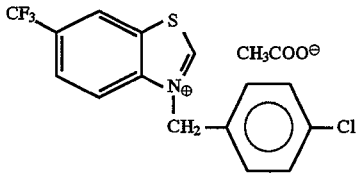

I-10

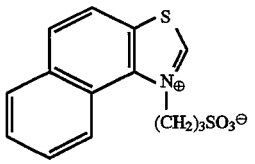

I-11

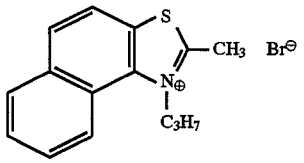

I-12

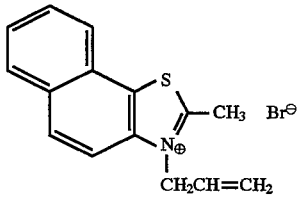

I-13

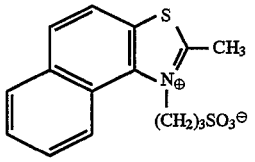

I-14

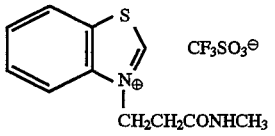

I-15

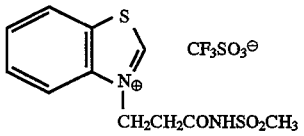

I-16

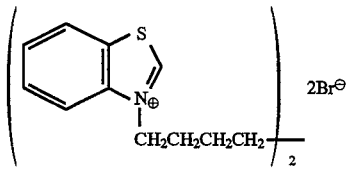

-continued

I-17

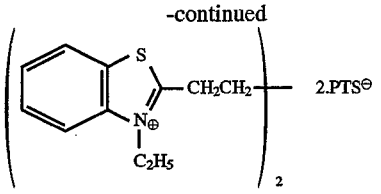

I-18

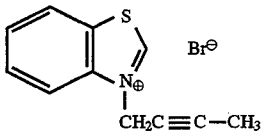

I-19

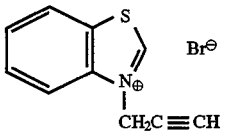

I-20

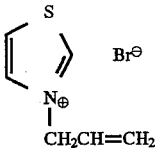

I-21

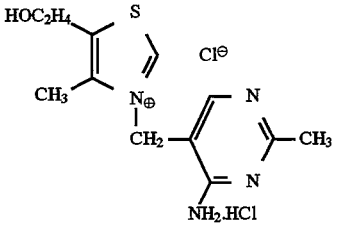

I-22

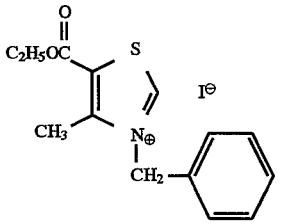

I-23

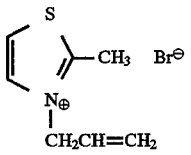

The compound represented by formula (I) of the present invention is preferably added during chemical sensitization, more preferably at the initial stage of chemical sensitization.

The compound represented by formula (I) is added in an amount of preferably from $1.0\times10^{-8}$ to $5.0\times10^{-6}$ mol per the unit surface area (1 $m^2$) of the emulsion grain, more preferably about 5 times by mole the amount of selenium added during the grain formation.

The compound represented by formula (I) may be dissolved in water or in an organic solvent miscible with water (e.g., methanol) and then added in the form of fine dispersion in a gelatin solution.

As the spectral sensitizing dye for use in the present invention, a methine dye is usually used and examples thereof include a cyanine dye, a merocyanine dye, a composite cyanine dye, a composite merocyanine dye, a holopolar cyanine dye, a hemicyanine dye, a styryl dye and a hemioxonol dye. In these dyes, any of nuclei commonly used as a basic heterocyclic nucleus in a cyanine dye can be used. More specifically, examples of the nucleus include pyrroline, oxazoline, thiazoline, pyrrole, oxazole, thiazole, selenazole, imidazole, tetrazole, pyridine, a nucleus resulting from fusion of an allcyclic hydrocarbon ring to the above-described nuclei and a nucleus resulting from fusion of an aromatic hydrocarbon ring to the above-described nuclei, such as indolenine, benzindolenine, indole, benzoxazole, naphthoxazole, benzthiazole, naphthothiazole, benzoselenazole, benzimidazole and quinoline. These nuclei may be substituted on the carbon atom.

In the merocyanine dye or the composite merocyanine dye, a nucleus having a ketomethylene structure may be used and examples of the nucleus include 5- or 6-membered heterocyclic nuclei such as pyrazoline-5-one, thiohydantoin, 2-thioozaxolin-2,4-dione, thiazolin-2,4-dione, rhodanine and thiobabituric acid.

Among the above-described dyes, a particularly useful sensitizing dye in the present invention is a cyanine dye. Specific examples of the cyanine dye useful in the present invention include dyes represented by formula (II):

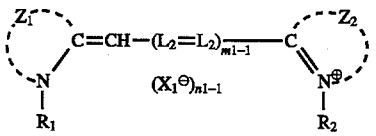

(II)

wherein $Z_1$ and $Z_2$ each represents a heterocyclic nucleus commonly used in a cyanine dye, more specifically, an atomic group necessary for forming a nucleus such as thiazole, thiazoline, benzothiazole, naphthothiazole, oxazole, oxazoline, benzoxazole, naphthoxazole, tetrazole, pyridine, quinoline, imidazoline, imidazole, benzimidazole, naphthoimidazole, selenazoline, selenazole, benzoselenazole, naphthoselenazole or indolenine. These nuclei may be substituted, for example, by a halogen atom, a lower alkyl group such as methyl, a phenyl group, a hydroxyl group, an alkoxy group having from 1 to 4 carbon atoms, a carboxyl group, an alkoxycarbonyl group, an alkylsulfamoyl group, an alkylcarbamoyl group, an acetyl group, an acetoxy group, a cyano group, a trichloromethyl group, a trifluoromethyl group or a nitro group.

$L_1$ and $L_2$ each represents a methine group or a substituted methine group. Examples of the substituted methine group include methine groups substituted by a lower alkyl group such as methyl or ethyl, a phenyl group, a substituted phenyl group, a methoxy group or an ethoxy group.

$R_1$ and $R_2$ each represents an alkyl group having from 1 to 5 carbon atoms; a substituted alkyl group having a carboxy group; a substituted alkyl group having a sulfo group such as β-sulfoethyl, γ-sulfopropyl, 6-sulfobutyl, 2-(3-sulfopropoxy)ethyl, 2-(2-(3-sulfopropoxy)ethoxy)ethyl or 2-hydroxy.sulfopropyl; or a substituted alkyl group used in an allyl group or commonly used in other N-substituted group of a cyanine dye.

$m_1$ represents 1, 2 or 3.

$X_1^-$ represents an acid anion commonly used in a cyanine dye such as iodide ion, bromide ion, p-toluenesulfonate ion or perchlorate ion.

$n_1$ represents 1 or 2 and when a betaine structure is formed, $n_1$ represents 1.

In a preferred embodiment, the spectral sensitization is conducted using two or more sensitizing dyes represented by formula (II).

In addition to the above-described dyes, the spectral sensitizing dye include those described, for example, in German Patent 929,080, U.S. Pat. Nos. 2,493,748, 2,503,776, 2,519,001, 2,912,329, 3,656,956, 3,672,897, 3,694,217, 4,025,349, 4,046,572, 2,688,545, 2,977,229, 3,397,060, 3,552,052, 3,527,641, 3,617,293, 3,628,964, 3,666,480, 3,672,898, 3,679,428, 3,703,377, 3,814,609, 3,837,862, 4,026,344, 1,242,588, 1,344,281 and 1,507,803, JP-B-44-14030, JP-B-52-24844, JP-B-43-4936, JP-B-53-12375, JP-A-52-110618, JP-A-52-109925 and JP-A-50-80827.

In the silver halide emulsion of the present invention, the spectral sensitizing dyes described in JP-A-4-362930 are preferably used.

Further, in the silver halide emulsion of the present invention, the spectral sensitizing dyes described in JP-A-5-127293 and JP-A-5-127291 are also preferably used.

The amount of the sensitizing dye added during preparation of a silver halide emulsion varies depending upon the kind of additives or the amount of silver halide and cannot be defined in a general way, however, the sensitizing dye may be added in an amount employed in a conventional method, namely, of from 50 to 80% of the saturation coating amount.

More specifically, the sensitizing dye is added in an amount of preferably from 0.001 to 100 mmol, more preferably from 0.01 to 10 mmol, per mol of silver halide.

The sensitizing dye is added after or before chemical sensitization. The sensitizing dye is added to the silver halide grain of the present invention during chemical ripening or before chemical ripening (for example, during grain formation or before physical ripening).

A dye which has no spectral sensitization effect by itself or a substance which absorbs substantially no visible light, but which shows supersensitization may be added to the emulsion together with the sensitizing dye. Examples of such a dye or substance include an aminostyryl compound substituted by a nitrogen-containing heterocyclic group (those described, for example, in U.S. Pat. Nos. 2,933,390 and 3,635,721), an aromatic organic acid formaldehyde condensate (those described, for example, in U.S. Pat. No. 3,743,510), a cadmium salt and an azaindene compound. The combinations described in U.S. Pat. Nos. 3,615,613, 3,615,641, 3,617,295 and 3,635,721 are particularly useful.

The photographic emulsion for use in the present invention may contain various compounds for the purpose of preventing fogging during preparation or storage of a photographic material or during photographic processing or for stabilizing the photographic performance. A number of compounds known as an antifoggant or a stabilizer may be used and examples of the compound include azoles such as benzothiazolium salts, nitroindazoles, triazoles, benzotriazoles and benzimidazoles (particularly, a nitro- or halogen-substitution product); a heterocyclic mercapto compounds such as mercaptothiazoles, mercaptobenzothiazoles, mercaptobenzimidazoles, mercaptothiazoles, mercaptotetrazoles (particularly, 1-phenyl-5-mercaptotetrazole) and mercaptopyrimidines; the above-described heterocyclic mercapto compounds having a water-soluble group such as a carboxyl group or a sulfon group; thioketo compounds such as oxazolinethione; azaindenes such as tetrazaindenes (particularly, 4-hydroxy-substituted (1,3,3a,7) tetrazaindenes); and benzenesulfinic acids.

The antifoggant or stabilizer is usually added after application of chemical sensitization but preferably, it is added during chemical ripening or before initiation of chemical ripening. More specifically, as long as the time is during the grain formation process of a silver halide emulsion, the antifoggant or stabilizer may be added during the addition of a silver salt solution, between the addition and the initiation of chemical ripening, or during chemical ripening (within the term of chemical ripening, preferably within 50% of the term, more preferably within 20% of the term, from the initiation).

The present invention can be applied to various color or black-and-white photographic materials. Representative examples thereof include color negative film for general purpose or movies, color reversal film for slide or television, color paper, color positive film and color reversal paper, a color diffusion type photographic material and a heat developable color photographic material. Among these, the present invention is particularly preferably applied to color reversal film.

The photographic emulsion of the present invention can also be applied to a film for print making such as a lithographic film and a scanning film, an X-ray film for direct or indirect medical treatment or for industrial use, a black-and-white film for photographing, a back-and-white printing paper, a normal microfilm for COM, a silver salt diffusion transfer time light-sensitive material and a print-out type light-sensitive material.

The photographic material of the present invention is preferably a multilayer color photographic material comprising a support having thereon at least one silver halide emulsion layer and at least one light-insensitive layer, in many cases, having at least two silver halide emulsion layers sensitive to light in substantially different wavelength regions, and more preferably, having a color image formation unit consisting of a color image formation unit comprising a red-sensitive silver halide emulsion layer, a color image formation unit comprising a green-sensitive silver halide emulsion layer and a color image formation unit comprising a blue-sensitive silver halide emulsion layer. Further, the photographic material of the present invention comprises a silver halide emulsion layer containing at least one non-diffusible color forming coupler which forms a dye upon coupling with an oxidation product of an aromatic primary amine developing agent, more preferably comprises a blue-sensitive silver halide emulsion layer containing a yellow coupler, a green-sensitive silver halide emulsion layer containing a magenta coupler and a red-sensitive silver halide emulsion layer containing a cyan coupler. The multilayer color photographic material of the present invention is processed with a bleaching solution or a bleach-fixing solution after exposure and development.

In the production method of a photographic material according to the present invention, a photographically useful material is usually added to a photographic coating solution, namely, a hydrophilic colloid solution.

The photographic material of the present invention is usually imagewise exposed and then processed with an alkali developer containing a developing agent and after this color development, the color photographic material is processed with a processing solution having a bleaching ability containing a bleaching agent.

With respect to various techniques or inorganic/organic materials which can be used in the silver halide photographic emulsion of the present invention and in the silver halide photographic material using the same, those described in *Research Disclosure,* No. 308119 (1989) can be usually used.

In addition, specific examples of the techniques and inorganic/organic materials which can be used in a color photographic material to which the silver halide photographic emulsion of the present invention can be applied are described in the following portions of European Patent 436,938A2 and in patents set forth below.

| Item | Pertinent Portion |
|---|---|
| 1) Layer structure | from p. 146, line 34 to p. 147, line 25 |
| 2) Yellow coupler | from p. 137, line 35 to p. 146, line 33, p. 149, lines 21 to 23 |
| 3) Magenta coupler | p. 149, lines 24 to 28; European Patent 421,453A1, from p. 3, line 5 to p. 25, line 55 |
| 4) Cyan coupler | p. 149, lines 29 to 33; European Patent 432,804A2, from p. 3, line 28 to p. 40, line 2 |
| 5) Polymer coupler | p. 149, lines 34 to 38; European Patent 435,334A2, from p. 113, line 39 to p. 123, line 37 |
| 6) Colored coupler | from p. 53, line 42 to p. 137, line 34, p. 149, lines 39 to 45 |
| 7) Other functional coupler | from p. 7, line 1 to p. 53, line 41, from p. 149, line 46 to p. 150, line 3; European Patent 435,334A2, from p. 3, line 1 to p. 29, line 50 |
| 8) Antiseptic/antimold | p. 150, lines 25 to 28 |
| 9) Formalin scavenger | p. 149, lines 15 to 17 |
| 10) Other additives | p. 153, lines 38 to 47; European Patent 421,453A1, from p. 75, line 21 to p. 84, line 56 and from p. 27, line 40 to p. 37, line 40 |
| 11) Dispersion method | p. 150, lines 4 to 24 |
| 12) Support | p. 150, lines 32 to 34 |
| 13) Layer thickness, physical properties | p. 150, lines 35 to 49 |
| 14) Color development, black-and white development, fogging process | from p. 150, line 50 to p. 151, line 47; European Patent 442,323A2, p. 34, lines 11 to 54, p. 35, lines 14 to 22 |
| 15) Desilvering | from p. 151, line 48 to p. 152, line 53 |
| 16) Automatic developing machine | from p. 152, line 54 to p. 153, line 2 |
| 17) Water washing, stabilization | p. 153, lines 3 to 37 |

The present invention will be described below in greater detail, however, the present invention should not be construed as being limited thereto.

EXAMPLE 1

(1) Preparation of Emulsion

Preparation of Emulsion Em-1:

To an aqueous solution containing 12 g of potassium bromide and 25 g of inactive gelatin dissolved in 4 l of distilled water, a 14% aqueous potassium bromide solution and a 20% aqueous silver nitrate solution were added while stirring over 1 minute by a double jet method. During this process, the temperature was kept at 50° C. (10% of total silver amount was consumed at this addition (1)). Thereafter, a gelatin solution (17%, 300 ml) was added thereto, the temperature was elevated to 75° C., 40 ml of a 25% aqueous ammonium nitrate solution and 75 ml of 1N sodium hydroxide were added thereto, the mixture was allowed to stand for 15 minutes and then 500 ml of 1N $H_2SO_4$ was added thereto. Subsequently, a 20% aqueous potassium bromide solution and a 20% aqueous silver nitrate solution were added by a double jet method while keeping the temperature at 75° C. and the pAg at 8.4 (70% of the total silver amount was consumed this addition (2)). Then, the temperature was lowered to 45° C., the pAg was adjusted to 9.3 by adding potassium bromide and a 1.2% aqueous solution containing 2.4 g of potassium iodide was added at a constant rate over 2 minutes. Further, a 20% aqueous potassium bromide solution and a 20% aqueous silver nitrate solution were added by a double jet method while keeping the pAg at 8.4 over 10 minutes (20.0% of the total silver amount was consumed at this addition (3)). Subsequently, the resulting emulsion was washed with water at 35° C. by a known flocculation method and after adding gelatin thereto and heating the mixture at 60° C., the emulsion was subjected to optimal chemical sensitization using sodium benzenethiosulfonate, sodium thiosulfate, sodium thiocyanate and chloroauric acid. After the completion of chemical sensitization, 0.25 g of Compound F-3 was added and then 25.0 ml of a 1% aqueous KI solution was added thereto to form a high silver iodide portion on the surface. Then, Sensitizing Dyes S-1 to S-4 were added each in an optimal amount to prepare Comparative Tabular AgBrI (AgI=2.0 mol %) Emulsion Em-1 having a circle-corresponding diameter of 0.70 μm and a thickness of 0.16 μm.

Preparation of Emulsion Em-2:

Comparative Tabular AgBrI (AgI=2.0 mol %) Emulsion Em-2 was prepared in the same manner as Emulsion Em-1 except for using dimethylselenourea in combination at the chemical sensitization in the preparation of Emulsion Em-1.

Preparation of Emulsions Em-3 to Em-8:

Tabular AgBrI (AgI=2.0 mol %) Emulsions Em-3 to Em-8 (Em-3 and Em-8: Comparison, Em-4 to Em-7: Invention) each having a circle-corresponding diameter of 0.70 μm and a thickness of 0.16 μm were prepared in the same manner as Emulsion Em-1 except that potassium selenocyanate was added in an amount of $0.6\times10^{-8}$ mol, $1.0\times10^{-8}$ mol, $4.5\times10^{-8}$ mol, $1.0\times10^{-7}$ mol, $1.0\times10^{-6}$ mol and $2.0\times10^{-6}$ mol, respectively, per the unit surface area (1 $m^2$) of the grain on the way when 40% of the total silver amount was added.

Preparation of Emulsions Em-9 to Em-11:

Comparative Tabular AgBrI (AgI=2.0 mol %) Emulsions Em-9 to Em-11 each having a circle-corresponding diameter of 0.70 μm and a thickness of 0.16 μm were prepared in the same manner as Emulsion Em-1 except that potassium selenocyanate was added in an amount of $1.2\times10^{-8}$, $4.5\times10^{-8}$ and $1.0\times10^{-7}$ mol, respectively, per the unit surface area (1 $m^2$) of the grain on the way when 55% of the total silver amount was added.

Preparation of Emulsions Em-12 to Em-24:

Comparative Tabular AgBrI (AgI=2.0 mol %) Emulsions Em-11 to Em-14 each having a circle-corresponding diameter of 0.70 μm and a thickness of 0.16 μm were prepared in the same manner as Emulsion Em-1 except that potassium selenocyanate was added in an amount of $1.2\times10^{-8}$, $4.5\times10^{-8}$ and $1.0\times10^{-7}$ mol, respectively, per the unit surface area (1 $m^2$) of the grain on the way when 70% of the total silver amount was added.

Preparation of Emulsion Em-15:

To an aqueous solution containing 0.9 g of potassium bromide, 50 g of inactive gelatin and 4.5 g of ammonium nitrate dissolved in 1 l of distilled water, 17.4 ml of 1N sodium hydroxide was added while stirring and thereto a 2.7% aqueous potassium bromide solution containing 0.16 g of potassium iodide in 100 ml and a 4% aqueous silver nitrate solution were added over 10 minutes by a double jet method. During this process, the temperature and the pAg were kept at 72° C. and 7.1, respectively (10% of total silver amount was consumed at this addition (1)). Thereafter, a 13.5% aqueous potassium bromide solution containing 0.8 g of potassium iodide in 100 ml and a 20% aqueous silver nitrate solution were added over 37 minutes by a double jet method while keeping the temperature and the pAg at 72° C. and 6.9, respectively (70% of the total silver amount was consumed this addition (2)). Then, a 13.5% aqueous potassium bromide solution containing 0.8 g of potassium iodide in 100 ml and a 20% aqueous silver nitrate solution were added over 10 minutes by a double jet method while keeping the temperature and the pAg at 72° C. and 7.4, respectively (20.0% of the total silver amount was consumed at this addition (3)). Subsequently, the resulting emulsion was washed with water at 35° C. by a known flocculation method and after adding gelatin thereto and heating the mixture at 60° C., the emulsion was subjected to optimal chemical sensitization using sodium benzenethiosulfonate, sodium thiosulfate, sodium thiocyanate and chloroauric acid. After the completion of chemical sensitization, 0.20 g of Compound F-3 was added and then 16 ml of a 1% aqueous KI solution was added thereto to form a high silver iodide portion on the surface. Then, Sensitizing Dyes S-7 and S-9 were added each in an optimal amount to prepare Comparative Cubic AgBrI (AgI=4.0 mol %) Emulsion Em-15 having an average grain diameter of 0.40 μm.

Preparation of Emulsion Em-16:

Comparative Cubic AgBrI (AgI=4.0 mol %) Emulsion Em-16 having an average grain diameter of 0.40 μm was prepared in the same manner as Emulsion Em-15 except for adding potassium selenocyanate in an amount of $4.5\times10^{-8}$ mol per the unit surface area (1 $m^2$) of the grain on the way when 40% of the total silver amount was consumed.

Preparation of Emulsion 17:

To an aqueous solution containing 0.9 g of potassium bromide, 50 g of inactive gelatin and 4.0 g Of ammonium nitrate dissolved in 1 l of distilled water, 12.0 ml of 1N sodium hydroxide was added while stirring and thereto a 4% aqueous potassium bromide solution and a 4% aqueous silver nitrate solution were added over 5 minutes by a double jet method. During this process, the temperature and the pAg were kept at 72° C. and 7.1, respectively (10% of total silver amount was consumed at this addition (1)).

Subsequently, a 20% aqueous potassium bromide solution containing potassium iodide so that 4.1 g of potassium iodide could be added and a 20% aqueous silver nitrate solution were added over 37 minutes by a double jet method while keeping the temperature and the pAg at 72° C. and 8.3, respectively (70% of the total silver amount was consumed this addition (2)). Further, a 20% aqueous potassium bromide solution and a 20% aqueous silver nitrate solution were added over 10 minutes by a double jet method while keeping the temperature and the pAg at 72° C. and 8.5, respectively (20% of the total silver amount was consumed at this addition (3)).

Subsequently, the resulting emulsion was ripened at 50° C. with sodium thiocyanate for 20 minutes. Then, the resulting emulsin was washed with water at 35° C. by a known flocculation method and after adding gelatin thereto and heating the mixture at 60° C., the emulsion was subjected to optimal chemical sensitization using sodium benzenethiosulfonate, sodium thiosulfate, sodium thiocyanate and chloroauric acid. After the completion of chemical sensitization, 0.25 g of Compound F-3 was added and then 25.0 ml of a 1% aqueous KI solution was added thereto to form a high silver iodide portion on the surface. Thereafter, Sensitizing Dyes S-7 and S-9 were added each in an optimal amount to prepare Comparative Octahedral AgBrI (AgI=3.5 mol %) Emulsion Em-17 having an average grain diameter of 0.30 μm.

Preparation of Emulsion Em-18:

Comparative Cubic AgBrI (AgI=3.5 mol %) Emulsion Em-18 having an average grain diameter of 0.30 μm was prepared in the same manner as Emulsion Em-16 except for adding potassium selenocyanate in an amount of $4.5\times10^{-8}$ mol per the unit surface area (1 $m^2$) of the grain on the way when 40% of the total silver amount was consumed.

Preparation of Emulsion Em-19:

To 0.75 l of a 0.8% low-molecular (molecular weight: 10,000) gelatin solution containing 0.025 mol of potassium bromide, 0.5M silver nitrate solution and 24 ml of 0.5M potassium bromide solution the same as above were added while stirring by a double jet method over 40 seconds. During this process, the gelatin solution was kept at 40° C. Thus, nucleation was conducted. At the nucleation, the gelatin solution had a pH of 5.0.

After the nucleation, the electric potential was adjusted with KBr to give a pBr of 2.05 and then the temperature was elevated to 75° C. 220 ml of a 10% deionized alkali-processed bone gelatin solution was added thereto and then the emulsion was ripened for 10 minutes.

Thereafter, 150 g of silver nitrate, potassium iodide and a potassium bromide solution were added within 60 minutes at an accelerated flow rate according to a controlled double jet method where the flow rate at the completion became 19 times the flow rate at the initiation, while keeping the electric potential of 10 mV to grow grains. After the completion of the growing, the temperature was lowered to 50° C., the pBr was adjusted to 1.5 with potassium bromide and then 300 ml of a 1% potassium iodide solution was added thereto. Thereafter, 327 ml of a 0.5M silver nitrate solution and a 0.5M potassium bromide solution were added thereto over 20 minutes by a controlled double jet method at an electric potential of 0 mV to form the shell. Subsequently, the resulting emulsion was washed with water at 35° C. by a known flocculation method and after adding gelatin thereto and heating the mixture at 60° C., the emulsion was subjected to optimal chemical sensitization using sodium benzenethiosulfonate, sodium thiosulfate, sodium thiocyanate and chloroauric acid. After the completion of chemical sensitization, Compound F-3 was added and then a 1% aqueous KI solution was added thereto to form a high silver iodide portion on the surface. Thereafter, Sensitizing Dyes S-7, S-9 and S-10 were added each in an optimal amount to prepare Comparative Tabular AgBrI (AgI=2.5 mol %) Emulsion Em-19 having a coefficient of variation of the projected area circle-corresponding diameter (hereinafter referred to as circle-corresponding diameter) of 10%, a circle-corresponding diameter of 1.30 μm and an average thickness of 0.26 μm.

Preparation of Emulsions Em-20 to Em-25:

Comparative Tabular AgBrI (AgI=2.5 mol %) Emulsions Em-20 to Em-25 each having a circle-corresponding diameter of 1.30 μm and a thickness of 0.26 μm were prepared in the same manner as Emulsion Em-19 except that potassium selenocyanate was added in an amount of $0.6\times10^{-8}$ mol, $1.0\times10^{-8}$ mol, $4.5\times10^{-8}$ mol, $1.0\times10^{-7}$ mol, $1.0\times10^{-6}$ mol and $2.0\times10^{-6}$ mol, respective per the unit area (1 $m^2$) of the grain on the way when 35% of the total silver amount was consumed.

Preparation of Emulsions Em-26 to Em-28:

Comparative Tabular AgBrI (AgI=2.5 mol %) Emulsions Em-26 to Em-28 each having a circle-corresponding diameter of 1.30 μm and a thickness of 0.26 μm were prepared in the same manner as Emulsion Em-19 except that potassium selenocyanate was added in an amount of $1.0\times10^{-8}$ mol, $4.5\times10^{-8}$ mol and $1.0\times10^{-7}$ mol, respectively, per the unit area (1 $m^2$) of the grain on the way when 60% of the total silver amount was consumed.

Preparation of Emulsions Em-29 to Em-31:

Comparative Tabular AgBrI (AgI=2.5 mol %) Emulsions Em-29 to Em-31 each having a circle-corresponding diameter of 1.30 μm and a thickness of 0.26 μm were prepared in the same manner as Emulsion Em-19 except that potassium selenocyanate was added in an amount of $1.0\times10^{-8}$ mol, $4.5\times10^{-8}$ mol and $1.0\times10^{-7}$ mol, respectively, per the unit area (1 $m^2$) of the grain on the way when 80% of the total silver amount was consumed.

Preparation of Emulsion Em-32:

To 0.75 l of a 0.8% low-molecular (molecular weight: 10,000) gelatin solution containing 0.025 mol of potassium bromide, 14 ml of a 0.5M silver nitrate solution and 14 ml of a 0.5M potassium bromide solution the same as above were added while stirring by a double jet method over 40 seconds. During this process, the gelatin solution was kept at 40° C. Thus, nucleation was conducted. At the nucleation, the gelatin solution had a pH of 5.0.

After the nucleation, the electric potential was adjusted with KBr to give a pBr of 2.05 and then the temperature was elevated to 75° C. 220 ml of a 10% deionized alkali-processed bone gelatin solution was added thereto and then the emulsion was ripened for 10 minutes.

Thereafter, 150 g of silver nitrate and a potassium iodide and potassium bromide solution were added within 60 minutes at an accelerated flow rate according to a controlled double jet method where the flow rate at the completion became 19 times the flow rate at the initiation, while keeping the electric potential of −10 mV to grow grains. On the way when 40% of the total silver amount was added, potassium selenocyanate was doped in an amount of $4.5\times10^{-8}$ mol per the unit surface area (1 $m^2$) of the grain. After the completion of growing, the temperature was lowered to 50° C., the pBr was adjusted with potassium bromide to 1.5 and then 300 ml of a 1% potassium iodide solution was added. Thereafter, 327 ml of a 0.5M silver nitrate solution and a 0.5M potassium bromide solution were added thereto over 20 minutes by a controlled double jet method at an electric potential of −10 mV to form the shell. Subsequently, the resulting emulsion was washed with water at 35° C. by a known flocculation method and after adding gelatin thereto and heating the mixture at 60° C., the emulsion was subjected to optimal chemical sensitization using sodium benzenethiosulfonate, sodium thiosulfate, sodium thiocyanate and chloroauric acid. After the completion of chemical sensitization, Compound F-3 was added and then a 1% aqueous KI solution was added thereto to form a high silver iodide portion on the surface. Thereafter, Sensitizing Dyes S-11 to S-13 were added each in an optimal amount to prepare Comparative Tabular AgBrI (AgI=1.7 mol %) Emulsion Em-32 having a coefficient of variation of the projected area circle-corresponding diameter (hereinafter referred to as circle-corresponding diameter) of 10%, a circle-corresponding diameter of 2.2 μm and an average thickness of 0.15 μm.

Preparation of Emulsions Em-33 to Em-37:

Tabular AgBrI (AgI=1.7 mol %) Emulsions Em-33 to Em-37 of the present invention each having a circle-corresponding diameter of 2.2 μm and a thickness of 0.15 μm were prepared in the same manner as Emulsion Em-32 except that Compound I-1 was added in an amount of $0.6\times10^{-7}$ mol, $2.3\times10^{-7}$ mol, $1.0\times10^{-6}$ mol, $5.0\times10^{-6}$ mol and $8.0\times10^{-6}$ mol, respectively, per the unit surface area (1 $m^2$) of the grain before chemical sensitization in the preparation of Emulsion Em-32.

Preparation of Emulsions Em-38 to Em-41:

Tabular AgBrI (AgI=1.7 mol %) Emulsions Em-38 to Em-41 of the present invention each having a circle-corresponding diameter of 2.2 μm and a thickness of 0.15 μm were prepared in the same manner as Emulsion Em-34 except for replacing Compound I-1 by Compounds I-2, I-10, I-14 and I-18, respectively, in the preparation of Emulsion Em-34.

Preparation of Emulsion Em-42:

Tabular AgBrI (AgI=3.9 mol %) Emulsion Em-42 of the present invention having a circle-corresponding diameter of 0.4 μm and a thickness of 0.08 μm was prepared in the same manner as Emulsion Em-19 except that the silver amount, the temperature and the electric potential were changed, potassium selenocyanate was doped in an amount of $4.5\times10^{-8}$ mol per the unit surface area (1 $m^2$) of the grain at the time when 40% of the total silver amount was added, Compound I-1 was added before chemical sensitization in an amount of $2.3\times10^{-7}$ mol per the unit surface area (1 $m^2$) of the grain and the sensitizing dyes added were changed to S-7 and S-9.

Preparation of Emulsions Em-43 to Em-46:

Tabular AgBrI (AgI=3.9 mol %) Emulsions Em-43 to Em-46 of the present invention each having a circle-corresponding diameter of 0.4 μm and a thickness of 0.08 μm were prepared in the same manner as Emulsion Em-42 except that potassium thiocyanate was added in an amount of $6\times10^{-2}$ mol per mol of silver at the time when 25%, 50%, 75% and 100% of the total silver amount used for the grain formation were added, respectively, in the preparation of Emulsion Em-42.

Preparation of Emulsion Em-47:

Tabular AgBrI (AgI=3.9 mol %) Emulsion Em-47 of the present invention having a circle-corresponding diameter of 0.4 μm and a thickness of 0.07 μm was prepared in the same manner as Emulsion Em-42 except for omitting the addition of a 1% KI solution, displacing the KI in proportion thereto by the growing portion and changing the temperature and the electric potential in the preparation of Emulsion Em-42.

Preparation of Emulsions Em-48 to Em-50:

Tabular AgBrI (AgI=3.9 mol %) Emulsions Em-48 to Em-50 of the present invention each having a circle-corresponding diameter of 0.4 μm and a thickness of 0.07 μm were prepared in the same manner as Emulsion Em-47 except for changing the amount of potassium thiocyanate added to $4\times10^{-2}$ mol, $5\times10^{-2}$ mol and $7\times10^{-2}$ mol per mol of silver, respectively, in the preparation of Emulsion Em-47.

Preparation of Emulsion Em-51:

To 0.75 l of a 0.8% low-molecular (molecular weight: 10,000) gelatin solution containing 0.025 mol of potassium bromide, 41 ml of a 0.5M silver nitrate solution and 41 ml of a 0.5M potassium bromide solution the same as above were added while stirring by a double jet method over 40 seconds. During this process, the gelatin solution was kept at 40° C. Thus, nucleation was conducted. At the nucleation, the gelatin solution had a pH of 5.0.

After the nucleation, the electric potential was adjusted with KBr to give a pBr of 2.05 and then the temperature was elevated to 75° C. 220 ml of a 10% deionized alkali-processed bone gelatin solution was added thereto and then the emulsion was ripened for 10 minutes.

Thereafter, 150 g of silver nitrate, a potassium iodide solution and a potassium bromide solution were added within 60 minutes at an accelerated flow rate according to a controlled double jet method where the flow rate at the completion became 19 times the flow rate at the initiation, while keeping the electric potential of 0 mV to grow grains. On the way when 25% of the total silver amount was added, potassium thiocyanate was added in an amount of $6\times10^{-2}$ mol per the unit surface area (1 $m^2$) of the grain and, at the time when 40% of the total silver amount was added, potassium selenocyanate was added in an amount of $4.5\times10^{-8}$ mol per the unit area (1 $m^2$) of the grain. After the completion of growing, the temperature was lowered to 50° C., the pBr was adjusted with potassium bromide to 1.5 and then 300 ml of a 1% potassium iodide solution was added. Thereafter, 327 ml of a 0.5M silver nitrate solution and a 0.5M potassium bromide solution were added thereto over 20 minutes by a controlled double jet method at an electric potential of 0 mV to form the shell. Subsequently, the resulting emulsion was washed with water at 35° C. by a known flocculation method and after adding gelatin thereto and heating the mixture at 60° C., the emulsion was subjected to optimal chemical sensitization using Compound I-1 in an amount of $2.3\times10^{-7}$ mol per the unit surface area (1 $m^2$) of the grain, sodium benzenethiosulfonate, sodium thiosulfate, sodium thiocyanate and chloroauric acid. After the completion of chemical sensitization, 0.30 g of Compound F-3 was added and then 12 ml of a 1% aqueous KI solution was added thereto to form a high silver iodide portion on the surface. Thereafter, Sensitizing Dyes S-7, S-9 and S-10 were added each in an optimal amount to prepare Comparative Tabular AgBrI (AgI=1.7 mol %) Emulsion Em-51 having a coefficient of variation of the projected area circle-corresponding diameter (hereinafter referred to as circle-corresponding diameter) of 15%, a circle-corresponding diameter of 1.20 μm and an average thickness of 0.17 μm.

Preparation of Emulsions Em-52 to Em-54:

Tabular AgBrI (AgI=1.7 mol %) Emulsions Em-52 to Em-54 of the present invention each having a circle-corresponding diameter of 1.20 μm and a thickness of 0.17 μm were prepared in the same manner as Emulsion Em-51 except for adding potassium hexacyanoiridate(IV) in an amount of $7.2\times10^{-2}$ mol per the unit surface area (1 $m^2$) of the grain at the time when 10%, 30% and 50% of the total silver amount used for the grain formation were added, respectively, in the preparation of Emulsion Em-51.

Preparation of Emulsions Em-55 and Em-56:

Tabular AgBrI (AgI=1.7 mol %) Emulsions Em-55 and Em-56 of the present invention each having a circle-corresponding diameter of 1.20 μm and a thickness of 0.17 μm were prepared in the same manner as Emulsion Em-53 except for changing the amount of potassium hexacyanoiridate(IV) added to $3.4\times10^{-10}$ mol and $5.3\times10^{-10}$ mol per the unit surface area (1 $m^2$) of the grain, respectively, in the preparation of Emulsion Em-53.

Preparation of Emulsion Em-57:

Tabular AgBrI (AgI=1.7 mol %) Emulsion Em-57 of the present invention having a circle-corresponding diameter of 1.20 μm and a thickness of 0.17 μm was prepared in the same manner as Emulsion Em-55 except for using sodium thiosulfate and chloroauric acid in place of potassium selenocyanate and potassium hexacyanoiridate(VI) added during grain formation, respectively, in the preparation of Emulsion Em-55.

Preparation of Emulsion Em-58:

Tablular AgBrI Emulsion Em-58 having been reduction-sensitized of the present invention was prepared in the same manner as Emulsion Em-56 except for adding 2 mg of dioxythiourea (reduction sensitizer) after nucleation and repenning but before growth, and adding 44 mg of sodium ethylthiosulfonate after growth but before adjustment of pBr with potassium bromide.

The shape of each emulsion prepared above and the kind, the site and the amount of additives are shown in Tables 1 to 5 below.

TABLE 1

Grain Shape and Kind, Addition Site and Addition Amount of Dopant in Emulsions Em-1 to Em-18

| Emulsion No. | Shape | Grain Size (sphere-corresponding diameter) (μm) | Iodide Content (mol %) | Coefficient of Variation (%) | Aspect Ratio | Dopant Kind | Dopant Addition Site (ratio of silver added to total silver amount) (%) | Dopant Addition Amount (molar number per unit surface area (1 $m^2$) of grain) |
|---|---|---|---|---|---|---|---|---|
| Em-1 (Comparison) | tabular | 0.5 | 2.0 | 20 | 4.5 | — | — | — |
| Em-2 (Comparison) | " | " | " | " | " | — | — | — |
| Em-3 (Comparison) | " | " | " | " | " | KSeCN | 40 | $0.6 \times 10^{-8}$ |
| Em-4 (Invention) | " | " | " | " | " | " | " | $1.0 \times 10^{-8}$ |
| Em-5 (Invention) | " | " | " | " | " | " | " | $4.5 \times 10^{-8}$ |
| Em-6 (Invention) | " | " | " | " | " | " | " | $1.0 \times 10^{-7}$ |
| Em-7 (Invention) | " | " | " | " | " | " | " | $1.0 \times 10^{-6}$ |
| Em-8 (Comparison) | " | " | " | " | " | " | " | $2.0 \times 10^{-6}$ |
| Em-9 (Comparison) | " | " | " | " | " | " | 55 | $1.2 \times 10^{-8}$ |
| Em-10 (Comparison) | " | " | " | " | " | " | " | $4.5 \times 10^{-8}$ |
| Em-11 (Comparison) | " | " | " | " | " | " | " | $1.0 \times 10^{-7}$ |
| Em-12 (Comparison) | " | " | " | " | " | " | 70 | $1.2 \times 10^{-8}$ |
| Em-13 (Comparison) | " | " | " | " | " | " | " | $4.5 \times 10^{-8}$ |
| Em-14 (Comparison) | " | " | " | " | " | " | " | $1.0 \times 10^{-7}$ |
| Em-15 (Comparison) | cubic | 0.4 | 4.0 | 7 | — | — | — | |
| Em-16 (Invention) | " | " | " | " | — | KSeCN | 40 | $4.5 \times 10^{-8}$ |
| Em-17 (Comparison) | octahedral | 0.3 | 3.5 | 10 | — | — | — | — |
| Em-18 (Invention) | " | " | " | " | — | KSeCN | 40 | $4.5 \times 10^{-8}$ |

TABLE 2

Grain Shape and Kind, Addition Site and Addition Amount of Dopant in Emulsions Em-19 to Em-31

| Emulsion No. | Shape | Grain Size (circle-corresponding diameter) (μm) | Iodide Content (mol %) | Coefficient of Variation (%) | Aspect Ratio | Dopant Kind | Dopant Addition Site (ratio of silver added to total silver amount) (%) | Dopant Addition Amount (molar number per unit surface area (1 $m^2$) of grain) |
|---|---|---|---|---|---|---|---|---|
| Em-19 (Comparison) | tabular | 1.30 | 2.5 | 10 | 5 | — | — | — |
| Em-20 (Comparison) | " | " | " | " | " | KSeCN | 35 | $0.6 \times 10^{-8}$ |
| Em-21 (Invention) | " | " | " | " | " | " | " | $1.0 \times 10^{-8}$ |
| Em-22 (Invention) | " | " | " | " | " | " | " | $4.5 \times 10^{-8}$ |
| Em-23 (Invention) | " | " | " | " | " | " | " | $1.0 \times 10^{-7}$ |
| Em-24 (Invention) | " | " | " | " | " | " | " | $1.0 \times 10^{-6}$ |
| Em-25 (Comparison) | " | " | " | " | " | " | " | $2.0 \times 10^{-6}$ |
| Em-26 (Comparison) | " | " | " | " | " | " | 60 | $1.0 \times 10^{-8}$ |
| Em-27 (Comparison) | " | " | " | " | " | " | " | $4.5 \times 10^{-8}$ |
| Em-28 (Comparison) | " | " | " | " | " | " | " | $1.0 \times 10^{-7}$ |
| Em-29 (Comparison) | " | " | " | " | " | " | 80 | $1.0 \times 10^{-8}$ |
| Em-30 (Comparison) | " | " | " | " | " | " | " | $4.5 \times 10^{-8}$ |
| Em-31 (Comparison) | " | " | " | " | " | " | " | $1.0 \times 10^{-7}$ |

TABLE 3

Grain Shape and Kind, Addition Site and Addition Amount of Additive in Emulsions Em-32 to Em-41

| Emulsion No. | Shape | Grain Size (circle-corresponding diameter) (μm) | Iodide Content (mol %) | Coefficient of Variation (%) | Aspect Ratio | Additive Kind | Additive Addition Site (ratio of silver added to total silver amount) (%) | Additive Addition Amount (molar number per unit surface area (1 $m^2$) of grain) |
|---|---|---|---|---|---|---|---|---|
| Em-32 (Invention) | tabular | 2.2 | 1.7 | 10 | 15 | KSeCN | 40 | $4.5 \times 10^{-8}$ |
| Em-33 (Invention) | " | " | " | " | " | KSeCN | 40 | $4.5 \times 10^{-8}$ |
| | | | | | | I-1 | before chemical sensitization | $0.6 \times 10^{-7}$ |

TABLE 3-continued

Grain Shape and Kind, Addition Site and Addition Amount of Additive in Emulsions Em-32 to Em-41

| Emulsion No. | Shape | Grain Size (circle-corresponding diameter) (μm) | Iodide Content (mol %) | Coefficient of Variation (%) | Aspect Ratio | Additive Kind | Additive Addition Site (ratio of silver added to total silver amount) (%) | Additive Addition Amount (molar number per unit surface area (1 $m^2$) of grain) |
|---|---|---|---|---|---|---|---|---|
| Em-34 (Invention) | " | " | " | " | " | KSeCN<br>I-1 | 40<br>before chemical sensitization | $4.5 \times 10^{-8}$<br>$2.3 \times 10^{-7}$ |
| Em-35 (Invention) | " | " | " | " | " | KSeCN<br>I-1 | 40<br>before chemical sensitization | $4.5 \times 10^{-8}$<br>$1.0 \times 10^{-6}$ |
| Em-36 (Invention) | " | " | " | " | " | KSeCN<br>I-1 | 40<br>before chemical sensitization | $4.5 \times 10^{-8}$<br>$5.0 \times 10^{-6}$ |
| Em-37 (Invention) | " | " | " | " | " | KSeCN<br>I-1 | 40<br>before chemical sensitization | $4.5 \times 10^{-8}$<br>$8.0 \times 10^{-6}$ |
| Em-38 (Invention) | " | " | " | " | " | KSeCN<br>I-2 | 40<br>before chemical sensitization | $4.5 \times 10^{-8}$<br>$2.3 \times 10^{-7}$ |
| Em-39 (Invention) | " | " | " | " | " | KSeCN<br>I-10 | 40<br>before chemical sensitization | $4.5 \times 10^{-8}$<br>$2.3 \times 10^{-7}$ |
| Em-40 (Invention) | tabular | 2.2 | 1.7 | 10 | 15 | KSeCN<br>I-14 | 40<br>before chemical sensitization | $4.5 \times 10^{-8}$<br>$2.3 \times 10^{-7}$ |
| Em-41 (Invention) | " | " | " | " | " | KSeCN<br>I-18 | 40<br>before chemical sensitization | $4.5 \times 10^{-8}$<br>$2.3 \times 10^{-7}$ |

TABLE 4

Grain Shape and Kind, Addition Site and Addition Amount of Additive in Emulsions Em-42 to Em-50

| Emulsion No. | Shape | Grain Size (circle-corresponding diameter) (μm) | Iodide Content (mol %) | Coefficient of Variation (%) | Aspect Ratio | Additive Kind | Additive Addition Site (ratio of silver added to total silver amount) (%) | Additive Addition Amount (molar number per unit surface area (1 $m^2$) of grain) |
|---|---|---|---|---|---|---|---|---|
| Em-42 (Invention) | tabular | 0.4 | 3.9 | 10 | 5 | KSeCN<br>I-1 | 40<br>before chemical sensitization | $4.5 \times 10^{-8}$<br>$2.3 \times 10^{-7}$ |
| Em-43 (Invention) | " | " | " | " | " | KSeCN<br>I-1 | 40<br>before chemical sensitization | $4.5 \times 10^{-8}$<br>$2.3 \times 10^{-7}$ |
| Em-44 (Invention) | " | " | " | " | " | KSCN<br>KSeCN<br>I-1 | 25<br>40<br>before chemical sensitization | $6 \times 10^{-2}$*<br>$4.5 \times 10^{-8}$<br>$2.3 \times 10^{-7}$ |
| Em-45 (Invention) | " | " | " | " | " | KSCN<br>KSeCN<br>I-1 | 50<br>40<br>before chemical sensitization | $6 \times 10^{-2}$*<br>$4.5 \times 10^{-8}$<br>$2.3 \times 10^{-7}$ |
| Em-46 (Invention) | " | " | " | " | " | KSCN<br>KSeCN<br>I-1 | 75<br>40<br>before chemical sensitization | $6 \times 10^{-2}$*<br>$4.5 \times 10^{-8}$<br>$2.3 \times 10^{-7}$ |
| Em-47 (Invention) | " | " | " | " | 6 | KSCN<br>KSeCN<br>I-1 | 100<br>40<br>before chemical sensitization | $6 \times 10^{-2}$*<br>$4.5 \times 10^{-8}$<br>$2.3 \times 10^{-7}$ |
| Em-48 (Invention) | " | " | " | " | " | KSCN<br>KSeCN<br>I-1 | 25<br>40<br>before chemical sensitization | $6 \times 10^{-2}$*<br>$4.5 \times 10^{-8}$<br>$2.3 \times 10^{-7}$ |
| Em-49 (Invention) | tabular | 0.4 | 3.9 | 10 | 5 | KSCN<br>KSeCN<br>I-1 | 25<br>40<br>before chemical sensitization | $4 \times 10^{-2}$*<br>$4.5 \times 10^{-8}$<br>$2.3 \times 10^{-7}$ |
| | | | | | | KSCN | 25 | $5 \times 10^{-2}$* |

TABLE 4-continued

Grain Shape and Kind, Addition Site and Addition Amount of Additive in Emulsions Em-42 to Em-50

| Emulsion No. | Shape | Grain Size (circle-corresponding diameter) (μm) | Iodide Content (mol %) | Coefficient of Variation (%) | Aspect Ratio | Additive Kind | Addition Site (ratio of silver added to total silver amount) (%) | Addition Amount (molar number per unit surface area (1 $m^2$) of grain) |
|---|---|---|---|---|---|---|---|---|
| Em-50 (Invention) | " | " | " | " | " | KSeCN | 40 | $4.5 \times 10^{-8}$ |
| | | | | | | I-1 | before chemical sensitization | $2.3 \times 10^{-7}$ |
| | | | | | | KSCN | 25 | $7 \times 10^{-2}$* |

*addition amount (mol) per mol of silver

TABLE 5

Grain Shape and Kind, Addition Site and Addition Amount of Additive in Emulsions Em-51 to Em-57

| Emulsion No. | Shape | Grain Size (circle-corresponding diameter) (μm) | Iodide Content (mol %) | Coefficient of Variation (%) | Aspect Ratio | Additive Kind | Addition Site (ratio of silver added to total silver amount) (%) | Addition Amount (molar number per unit surface area (1 $m^2$) of grain) |
|---|---|---|---|---|---|---|---|---|
| Em-51 (Invention) | tabular | 1.20 | 1.7 | 10 | 7 | KSeCN | 40 | $4.5 \times 10^{-8}$ |
| | | | | | | I-1 | before chemical sensitization | $2.3 \times 10^{-7}$ |
| | | | | | | KSCN | 25 | $6 \times 10^{-2}$* |
| Em-52 (Invention) | " | " | " | " | " | KSeCN | 40 | $4.5 \times 10^{-8}$ |
| | | | | | | I-1 | before chemical sensitization | $2.3 \times 10^{-7}$ |
| | | | | | | KSCN | 25 | $6 \times 10^{-2}$* |
| | | | | | | $K_3[Ir(CN)_6]$ | 10 | $7.2 \times 10^{-10}$ |
| Em-53 (Invention) | " | " | " | " | " | KSeCN | 40 | $4.5 \times 10^{-8}$ |
| | | | | | | I-1 | before chemical sensitization | $2.3 \times 10^{-7}$ |
| | | | | | | KSCN | 25 | $6 \times 10^{-2}$* |
| | | | | | | $K_3[Ir(CN)_6]$ | 30 | $7.2 \times 10^{-10}$ |
| Em-54 (Invention) | " | " | " | " | " | KSeCN | 40 | $4.5 \times 10^{-8}$ |
| | | | | | | I-1 | before chemical sensitization | $2.3 \times 10^{-7}$ |
| | | | | | | KSCN | 25 | $6 \times 10^{-2}$* |
| | | | | | | $K_3[Ir(CN)_6]$ | 50 | $7.2 \times 10^{-10}$ |
| Em-55 (Invention) | " | " | " | " | " | KSeCN | 40 | $4.5 \times 10^{-8}$ |
| | | | | | | I-1 | before chemical sensitization | $2.3 \times 10^{-7}$ |
| | | | | | | KSCN | 25 | $6 \times 10^{-2}$* |
| | | | | | | $K_3[Ir(CN)_6]$ | 30 | $3.4 \times 10^{-10}$ |
| Em-56 (Invention) | tabular | 1.20 | 1.7 | 10 | 6 | KSeCN | 40 | $4.5 \times 10^{-8}$ |
| | | | | | | I-1 | before chemical sensitization | $2.3 \times 10^{-7}$ |
| | | | | | | KSCN | 25 | $6 \times 10^{-2}$* |
| | | | | | | $K_3[Ir(CN)_6]$ | 30 | $5.3 \times 10^{-10}$ |
| Em-57 (Comparison) | " | " | " | " | " | KSeCN | 40 | $4.5 \times 10^{-8}$ |
| | | | | | | I-1 | before chemical sensitization | $2.3 \times 10^{-7}$ |
| | | | | | | KSCN | 25 | $6 \times 10^{-2}$* |
| | | | | | | $HAuCl_4$ | 30 | $3.4 \times 10^{-10}$ |
| Em-58 (Invention) | " | " | " | " | " | KSeCN | 40 | $4.5 \times 10^{-8}$ |
| | | | | | | I-1 | before chemical sensitization | $2.3 \times 10^{-7}$ |
| | | | | | | KSCN | 25 | $6 \times 10^{-2}$* |
| | | | | | | $K_3[Ir(CN)_6]$ | 30 | $5.3 \times 10^{-10}$ |

*addition amount (mol) per mol of silver (2) Preparation of Coated Sample

To each of the emulsions prepared above, polyvinylbenzene sulfonate as a thickener, a vinylsulfon-based compound as a hardening agent and Compound F-3 as a stabilizer were added to prepare emulsion coating solutions. The resulting coating solutions each was uniformly coated on a polyester support having applied thereto undercoating and thereon a surface protective layer mainly comprising an aqueous gelatin solution was coated to prepare Coated Samples 101 to 158 containing Emulsions 1 to 58, respectively.

In each sample, the coated silver amount was 1.2 g/m$^2$ and the gelatin coated amount of the protective layer was 2.0 g/m$^2$.

(3) Evaluation of Coated Sample (a) Sensitivity

Each sample was wedgewise exposed for 1/100 second and then developed with the following processing solution.

| Processing Solution | |
|---|---|
| 1-Phenyl-3-pyrazolidone | 0.5 g |
| Hydroquinone | 10 g |
| Disodium ethylenediaminetetraacetate | 2 g |
| Potassium sulfite | 60 g |
| Boric acid | 4 g |
| Potassium carbonate | 20 g |
| Sodium bromide | 5 g |

-continued

| Processing Solution | |
|---|---|
| Diethylene glycol | 20 g |
| pH adjusted with sodium hydroxide | 10.0 |
| Water to make | 1 liter |

The sensitivity was shown by a relative value to the reciprocal of an exposure amount giving a density of fog+0.2.

(b) Incubation durability

One part of each coated sample prepared above was stored in a freezer and another part was stored at 50° C. and 55% for 7 days. They were taken out, exposed and processed and a logarithm (ΔS1) of the sensitivity ratio therebetween was measured. It shows that the smaller the absolute value of ΔS1, the superior the incubation durability.

(c) Reciprocity law failure

Each coated sample prepared above was exposed for 1/100 second and 10 seconds with the same exposure amount and the sensitivity difference therebetween was measured. It shows that the smaller the sensitivity difference, the superior the reciprocity law failure.

The sensitivity is shown by a logarithm of the ratio of the exposure amount giving a density of fog+0.2 between samples processed as above.

The results of the above-described evaluations are shown in Tables 6 to 10.

TABLE 6

Capability of Coated Samples 101 to 118

| Coated Sample No. | Dopant Kind | Dopant Addition Site (silver addition ratio (%) to total silver amount) | Dopant Addition amount (molar number per unit surface area (1 m$^2$) of grain) | Relative Sensitivity | Fog | Incubation Durability (sensitivity after storage) - (sensitivity of control) |
|---|---|---|---|---|---|---|
| 101 (Comparison) | — | — | — | 100 | 0.07 | −0.01 |
| 102 (Comparison) | — | — | — | 125 | 0.12 | −0.05 |
| 103 (Comparison) | KSeCN | 40 | $0.6 \times 10^{-8}$ | 100 | 0.07 | −0.01 |
| 104 (Invention) | " | " | $1.0 \times 10^{-8}$ | 112 | 0.07 | −0.01 |
| 105 (Invention) | " | " | $4.5 \times 10^{-8}$ | 116 | 0.08 | −0.02 |
| 106 (Invention) | " | " | $1.0 \times 10^{-7}$ | 120 | 0.08 | −0.02 |
| 107 (Invention) | " | " | $1.0 \times 10^{-6}$ | 126 | 0.08 | −0.02 |
| 108 (Comparison) | " | " | $2.0 \times 10^{-6}$ | 124 | 0.11 | −0.04 |
| 109 (Comparison) | " | 55 | $1.0 \times 10^{-8}$ | 106 | 0.10 | −0.03 |
| 110 (Comparison) | " | " | $4.5 \times 10^{-8}$ | 108 | 0.10 | −0.04 |
| 111 (Comparison) | " | " | $1.0 \times 10^{-7}$ | 109 | 0.11 | −0.04 |
| 112 (Comparison) | " | 70 | $1.0 \times 10^{-8}$ | 104 | 0.10 | −0.03 |
| 113 (Comparison) | " | " | $4.5 \times 10^{-8}$ | 105 | 0.12 | −0.05 |
| 114 (Comparison) | " | " | $1.0 \times 10^{-7}$ | 107 | 0.13 | −0.05 |
| 115 (Comparison) | — | — | — | 100 | 0.09 | −0.01 |
| 116 (Invention) | KSeCN | 40 | $4.5 \times 10^{-8}$ | 110 | 0.15 | −0.04 |
| 117 (Comparison) | — | — | — | 100 | 0.07 | −0.01 |
| 118 (Invention) | KSeCN | 40 | $4.5 \times 10^{-8}$ | 108 | 0.08 | −0.02 |

TABLE 7

Capability of Coated Samples 119 to 131

| Coated Sample No. | Dopant Kind | Dopant Addition Site (silver addition ratio (%) to total silver amount) | Dopant Addition amount (molar number per unit surface area (1 $m^2$) of grain) | Relative Sensitivity | Fog | Incubation Durability (sensitivity after storage) - (sensitivity of control) |
|---|---|---|---|---|---|---|
| 119 (Comparison) | — | — | — | 100 | 0.07 | −0.01 |
| 120 (Comparison) | KSeCN | 35 | $0.6 \times 10^{-8}$ | 105 | 0.07 | −0.01 |
| 121 (Invention) | " | " | $1.0 \times 10^{-8}$ | 120 | 0.07 | −0.01 |
| 122 (Invention) | " | " | $4.5 \times 10^{-8}$ | 123 | 0.07 | −0.01 |
| 123 (Invention) | " | " | $1.0 \times 10^{-7}$ | 125 | 0.08 | −0.02 |
| 124 (Invention) | " | " | $1.0 \times 10^{-6}$ | 127 | 0.08 | −0.02 |
| 125 (Comparison) | " | " | $2.0 \times 10^{-6}$ | 119 | 0.12 | −0.05 |
| 126 (Comparison) | " | 60 | $1.0 \times 10^{-8}$ | 106 | 0.09 | −0.03 |
| 127 (Comparison) | " | " | $4.5 \times 10^{-8}$ | 108 | 0.10 | −0.04 |
| 128 (Comparison) | " | " | $1.0 \times 10^{-7}$ | 109 | 0.11 | −0.05 |
| 129 (Comparison) | " | 80 | $1.0 \times 10^{-8}$ | 105 | 0.10 | −0.03 |
| 130 (Comparison) | " | " | $4.5 \times 10^{-8}$ | 106 | 0.12 | −0.05 |
| 131 (Comparison) | " | " | $1.0 \times 10^{-7}$ | 108 | 0.13 | −0.05 |

TABLE 8

Capability of Coated Samples 132 to 141

| Coated Sample No. | Additive Kind | Additive Addition Site (silver addition ratio (%) to total silver amount) | Additive Addition amount (molar number per unit surface area (1 $m^2$) of grain) | Relative Sensitivity | Fog | Incubation Durability (sensitivity after storage) - (sensitivity of control) |
|---|---|---|---|---|---|---|
| 132 (Invention) | KSeCN | 40 | $4.5 \times 10^{-8}$ | 100 | 0.08 | −0.02 |
| 133 (Invention) | KSeCN | 40 | $4.5 \times 10^{-8}$ | 108 | 0.08 | −0.02 |
| | I-1 | before chemical sensitization | $0.6 \times 10^{-7}$ | | | |
| 134 (Invention) | KSeCN | 40 | $4.5 \times 10^{-8}$ | 113 | 0.08 | −0.02 |
| | I-1 | before chemical sensitization | $2.3 \times 10^{-7}$ | | | |
| 135 (Invention) | KSeCN | 40 | $4.5 \times 10^{-8}$ | 120 | 0.09 | −0.02 |
| | I-1 | before chemical sensitization | $1.0 \times 10^{-6}$ | | | |
| 136 (Invention) | KSeCN | 40 | $4.5 \times 10^{-8}$ | 128 | 0.09 | −0.02 |
| | I-1 | before chemical sensitization | $5.0 \times 10^{-6}$ | | | |
| 137 (Invention) | KSeCN | 40 | $4.5 \times 10^{-8}$ | 127 | 0.12 | −0.03 |
| | I-1 | before chemical sensitization | $8.0 \times 10^{-6}$ | | | |
| 138 (Invention) | KSeCN | 40 | $4.5 \times 10^{-8}$ | 125 | 0.08 | −0.02 |
| | I-2 | before chemical sensitization | $2.3 \times 10^{-7}$ | | | |
| 139 (Invention) | KSeCN | 40 | $4.5 \times 10^{-8}$ | 127 | 0.09 | −0.02 |
| | I-10 | before chemical sensitization | $2.3 \times 10^{-7}$ | | | |
| 140 (Invention) | KSeCN | 40 | $4.5 \times 10^{-8}$ | 126 | 0.09 | −0.02 |
| | I-14 | before chemical sensitization | $2.3 \times 10^{-7}$ | | | |
| 141 (Invention) | KSeCN | 40 | $4.5 \times 10^{-8}$ | 127 | 0.08 | −0.02 |
| | I-18 | before chemical sensitization | $2.3 \times 10^{-7}$ | | | |

TABLE 9

Capability of Coated Samples 142 to 150

| Coated Sample No. | Additive Kind | Addition Site (silver addition ratio (%) to total silver amount) | Addition amount (molar number per unit surface area (1 $m^2$) of grain) | Relative Sensitivity | Fog | Incubation Durability (sensitivity after storage) - (sensitivity of control) |
|---|---|---|---|---|---|---|
| 142 (Invention) | KSeCN | 40 | $4.5 \times 10^{-8}$ | 100 | 0.09 | −0.02 |
| | I-1 | before chemical sensitization | $2.3 \times 10^{-7}$ | | | |
| 143 (Invention) | KSeCN | 40 | $4.5 \times 10^{-8}$ | 113 | 0.09 | −0.02 |
| | I-1 | before chemical sensitization | $2.3 \times 10^{-7}$ | | | |
| | KSCN | 25 | $6 \times 10^{-2}$* | | | |
| 144 (Invention) | KSeCN | 40 | $4.5 \times 10^{-8}$ | 111 | 0.09 | −0.02 |
| | I-1 | before chemical sensitization | $2.3 \times 10^{-7}$ | | | |
| | KSCN | 50 | $6 \times 10^{-2}$* | | | |
| 145 (Invention) | KSeCN | 40 | $4.5 \times 10^{-8}$ | 111 | 0.09 | −0.02 |
| | I-1 | before chemical sensitization | $2.3 \times 10^{-7}$ | | | |
| | KSCN | 75 | $6 \times 10^{-2}$* | | | |
| 146 (Invention) | KSeCN | 40 | $4.5 \times 10^{-8}$ | 110 | 0.10 | −0.02 |
| | I-1 | before chemical sensitization | $2.3 \times 10^{-7}$ | | | |
| | KSCN | 100 | $6 \times 10^{-2}$* | | | |
| 147 (Invention) | KSeCN | 40 | $4.5 \times 10^{-8}$ | 100 | 0.09 | −0.02 |
| | I-1 | before chemical sensitization | $2.3 \times 10^{-7}$ | | | |
| | KSCN | 25 | $6 \times 10^{-2}$* | | | |
| 148 (Invention) | KSeCN | 40 | $4.5 \times 10^{-8}$ | 109 | 0.09 | −0.02 |
| | I-1 | before chemical sensitization | $2.3 \times 10^{-7}$ | | | |
| | KSCN | 25 | $4 \times 10^{-2}$* | | | |
| 149 (Invention) | KSeCN | 40 | $4.5 \times 10^{-8}$ | 111 | 0.09 | −0.02 |
| | I-1 | before chemical sensitization | $2.3 \times 10^{-7}$ | | | |
| | KSCN | 25 | $5 \times 10^{-2}$* | | | |
| 150 (Invention) | KSeCN | 40 | $4.5 \times 10^{-8}$ | 116 | 0.10 | −0.02 |
| | I-1 | before chemical sensitization | $2.3 \times 10^{-7}$ | | | |
| | KSCN | 25 | $7 \times 10^{-2}$* | | | |

*addition amount (mol) per mol of silver

TABLE 10

Capability of Coated Samples 151 to 157

| Coated Sample No. | Additive Kind | Addition Site (silver addition ratio (%) to total silver amount) | Addition amount (molar number per unit surface area (1 $m^2$) of grain) | Relative Sensitivity | Fog | Incubation Durability (sensitivity after storage) - (sensitiviety of control) | Reciprocity Law Failure Property (difference between 1/100 sec sensitivity and 10 sec. sensitivity) |
|---|---|---|---|---|---|---|---|
| 151 (Invention) | KSeCN | 40 | $4.4 \times 10^{-8}$ | 100 | 0.09 | −0.02 | 0.04 |
| | I-1 | before chemical sensitization | $2.2 \times 10^{-7}$ | | | | |
| | KSCN | 25 | $6 \times 10^{-2}$* | | | | |
| 152 (Invention) | KSeCN | 40 | $4.4 \times 10^{-8}$ | 100 | 0.09 | −0.02 | 0.02 |
| | I-1 | before chemical sensitization | $2.2 \times 10^{-7}$ | | | | |
| | KSCN | 25 | $6 \times 10^{-2}$* | | | | |
| | $K_3[Ir(CN)_6]$ | 10 | $7.2 \times 10^{-10}$ | | | | |
| 153 (Invention) | KSeCN | 40 | $4.4 \times 10^{-8}$ | 101 | 0.08 | −0.02 | 0.02 |
| | I-1 | before chemical sensitization | $2.2 \times 10^{-7}$ | | | | |
| | KSCN | 25 | $6 \times 10^{-2}$* | | | | |
| | $K_3[Ir(CN)_6]$ | 30 | $7.2 \times 10^{-10}$ | | | | |
| 154 (Invention) | KSeCN | 40 | $4.4 \times 10^{-8}$ | 100 | 0.09 | −0.02 | 0.02 |
| | I-1 | before chemical sensitization | $2.2 \times 10^{-7}$ | | | | |
| | KSCN | 25 | $6 \times 10^{-2}$* | | | | |

TABLE 10-continued

Capability of Coated Samples 151 to 157

| Coated Sample No. | Additive: Kind | Additive: Addition Site (silver addition ratio (%) to total silver amount) | Additive: Addition amount (molar number per unit surface area (1 $m^2$) of grain) | Relative Sensitivity | Fog | Incubation Durability (sensitivity after storage) - (sensitiviety of control) | Reciprocity Law Failure Property (difference between 1/100 sec sensitivity and 10 sec. sensitivity) |
|---|---|---|---|---|---|---|---|
| | $K_3[Ir(CN)_6]$ | 50 | $7.2 \times 10^{-10}$ | | | | |
| 155 (Invention) | KSeCN | 40 | $4.4 \times 10^{-8}$ | 100 | 0.09 | −0.02 | 0.03 |
| | I-1 | before chemical sensitization | $2.2 \times 10^{-7}$ | | | | |
| | KSCN | 25 | $6 \times 10^{-2}$* | | | | |
| | $K_3[Ir(CN)_6]$ | 30 | $3.4 \times 10^{-10}$ | | | | |
| 156 (Invention) | KSeCN | 40 | $4.4 \times 10^{-8}$ | 101 | 0.08 | −0.02 | 0.02 |
| | I-1 | before chemical sensitization | $2.2 \times 10^{-7}$ | | | | |
| | KSCN | 25 | $6 \times 10^{-2}$* | | | | |
| | $K_3[Ir(CN)_6]$ | 30 | $5.3 \times 10^{-10}$ | | | | |
| 157 (Comparison) | KSeCN | 40 | $4.4 \times 10^{-8}$ | 60 | 0.10 | −0.04 | 0.05 |
| | I-1 | before chemical sensitization | $2.2 \times 10^{-7}$ | | | | |
| | KSCN | 25 | $6 \times 10^{-2}$* | | | | |
| | $HAuCl_4$ | 30 | $7.2 \times 10^{-10}$ | | | | |
| 158 (Invention) | KSeCN | 40 | $4.4 \times 10^{-8}$ | 115 | 0.10 | −0.04 | 0.02 |
| | I-1 | before chemical sensitization | $2.2 \times 10^{-7}$ | | | | |
| | KSCN | 25 | $6 \times 10^{-2}$* | | | | |
| | $K_3[Ir(CN)_6]$ | 30 | $5.3 \times 10^{-10}$ | | | | |

*addition amount (mol) per mol of silver

It is seen from the results of Samples 101 to 131 shown in Tables 1 and 2 that samples having doped therein KSeCn on the way of emulsion grain formation have high sensitivity as compared with those experienced no doping and also excellent fog property and incubation durability as compared with Sample 102 of which surface was chemically sensitized using a labile selenium compound. It is also understood that the doping site is preferably in a first half of grain formation rather than in a latter half of grain formation as effected in patent publications described earlier and that an emulsion can first have excellent incubation durability and high sensitivity when the amount of dopant is increased. Upon comparison between Samples 115 to 118 and other samples, it is known to be preferred to apply doping of a selenocyanic acid compound to a tabular grain.

Further, it is seen from the results of Samples 132 to 141 shown in Table 8 that the sensitivity can be still elevated by using a nucleophilic agent in combination without involving increase in fog or deterioration of incubation durability.

Furthermore, it is seen from the results of Samples 142 to 150 shown in Table 9 that the sensitivity can be still elevated by adding potassium thiocyanate during grain formation and also it is seen from the results of Samples 151 to 158 shown in Table 10 that a high-sensitive emulsion having excellent reciprocity law failure can be prepared by using doping of iridium in combination.

EXAMPLE 2

(1) Preparation of Sample 201

A multi-layer color photographic material was prepared by providing layers each having the following composition on a 127 μm-thick cellulose triacetate film support having applied thereto undercoating and designated as Sample 201. The numerals each shows an addition amount per $m^2$. The effect of compounds is not limited to the use described below.

| | |
|---|---|
| First layer: antihalation layer | |
| Black colloidal silver | 0.30 g |
| Gelatin | 2.30 g |
| Ultraviolet Absorbent U-1 | 0.10 g |
| Ultraviolet Absorbent U-3 | 0.040 g |
| Ultraviolet Absorbent U-4 | 0.10 g |
| High Boiling Point Organic Solvent Oil-1 | 0.10 g |
| Fine crystal solid dispersion of Dye E-1 | 0.25 g |
| Fine crystal solid dispersion of Dye E-2 | 0.10 g |
| Second Layer: interlayer | |
| Gelatin | 0.40 g |
| Compound Cpd-A | 5.0 mg |
| High Boiling Point Organic Solvent Oil-3 | 0.10 g |
| Dye D-4 | 10.0 mg |
| Dye D-5 | 4.0 mg |
| Third Layer: interlayer | |
| Yellow colloidal silver | as silver 0.010 g |
| Gelatin | 0.40 g |
| Fourth Layer: low-sensitivity red-sensitive emulsion layer | |
| Emulsion | as silver 0.69 g |
| Gelatin | 0.80 g |
| Coupler C-1 | 0.10 g |
| Coupler C-2 | 0.04 g |
| Coupler C-6 | 0.050 g |
| Compound Cpd-A | 5.0 mg |
| Compound Cpd-E | 0.1 mg |
| High Boiling Point Organic Solvent Oil-2 | 0.10 g |
| Fifth Layer: medium-sensitivity red-sensitive emulsion layer | |
| Emulsion | as silver 0.50 g |
| Gelatin | 0.80 g |
| Coupler C-1 | 0.13 g |
| Coupler C-2 | 0.06 g |
| Coupler C-6 | 0.01 g |
| High Boiling Point Organic Solvent Oil-2 | 0.10 g |

-continued

| | |
|---|---|
| **Sixth Layer: high-sensitivity red-sensitive emulsion layer** | |
| Emulsion | as silver 0.50 g |
| Gelatin | 1.70 g |
| Coupler C-3 | 0.70 g |
| Coupler C-6 | 0.02 g |
| Additive P-1 | 0.20 g |
| High Boiling point Organic Solvent Oil-2 | 0.04 g |
| **Seventh Layer: interlayer** | |
| Gelatin | 0.60 g |
| Compound Cpd-D | 0.04 g |
| Compound Cpd-G | 0.16 g |
| Fine crystal solid dispersion of Dye E-4 | 0.02 g |
| **Eighth Layer: interlayer** | |
| Gelatin | 1.20 g |
| Compound Cpd-A | 0.10 g |
| Compound Cpd-B | 0.10 g |
| Compound Cpd-C | 0.17 g |
| High Boiling Point Organic Solvent Oil-3 | 0.20 g |
| **Ninth Layer: low-sensitivity green-sensitive emulsion layer** | |
| Emulsion | as silver 0.95 g |
| Gelatin | 0.50 g |
| Coupler C-7 | 0.03 g |
| Coupler C-8 | 0.09 g |
| Coupler C-10 | 0.04 g |
| Coupler C-11 | 0.04 g |
| Compound Cpd-A | 0.01 g |
| Compound Cpd-E | 0.01 g |
| Compound Cpd-F | 0.3 mg |
| High Boiling Point Organic Solvent Oil-2 | 0.10 g |
| **Tenth Layer: medium-sensitivity green-sensitive emulsion layer** | |
| Emulsion | as silver 0.50 g |
| Gelatin | 0.50 g |
| Coupler C-4 | 0.12 g |
| Coupler C-10 | 0.06 g |
| Coupler C-11 | 0.06 g |
| Compound Cpd-F | 0.03 g |
| High Boiling Point Organic Solvent Oil-2 | 0.01 g |
| **Eleventh Layer: high-sensitivity green-sensitive emulsion layer** | |
| Emulsion | as silver 0.44 g |
| Gelatin | 0.50 g |
| Coupler C-4 | 0.18 g |
| Coupler C-10 | 0.09 g |
| Coupler C-11 | 0.09 g |
| Compound Cpd-F | 0.080 g |
| High Boiling Point Organic Solvent Oil-2 | 0.020 g |
| **Twelfth Layer: interlayer** | |
| Gelatin | 0.30 g |
| **Thirteenth Layer: yellow filter layer** | |
| Yellow colloidal silver | as silver 0.08 g |
| Gelatin | 0.50 g |
| Compound Cpd-B | 0.02 g |
| Compound Cpd-D | 0.03 g |
| Compound Cpd-G | 0.10 g |
| Fine crystal solid dispersion of Dye E-3 | 0.27 g |

-continued

| | |
|---|---|
| **Fourteenth Layer: low-sensitivity blue-sensitive emulsion layer** | |
| Emulsion | as silver 0.43 g |
| Gelatin | 0.80 g |
| Coupler C-5 | 0.30 g |
| Coupler C-6 | 5.0 mg |
| Coupler C-9 | 0.03 g |
| **Fifteenth Layer: medium-sensitivity blue-sensitive emulsion layer** | |
| Emulsion | as silver 0.16 g |
| Gelatin | 0.60 g |
| Coupler C-5 | 0.30 g |
| Coupler C-6 | 5.0 mg |
| Coupler C-9 | 0.03 g |
| **Sixteenth Layer: high-sensitivity blue-sensitive emulsion layer** | |
| Emulsion | as silver 0.47 g |
| Gelatin | 2.60 g |
| Coupler C-5 | 0.10 g |
| Coupler C-6 | 0.12 g |
| Coupler C-9 | 1.00 g |
| High Boiling Point Organic Solvent Oil-2 | 0.40 g |
| **Seventeenth Layer: first protective layer** | |
| Gelatin | 1.00 g |
| Ultraviolet Absorbent U-1 | 0.10 g |
| Ultraviolet Absorbent U-2 | 0.03 g |
| Ultraviolet Absorbent U-5 | 0.20 g |
| Dye D-1 | 0.15 g |
| Dye D-2 | 0.050 g |
| Dye D-3 | 0.10 g |
| Dye D-4 | 0.01 g |
| Compound Cpd-H | 0.40 g |
| High Boiling Point Organic Solvent Oil-2 | 0.30 g |
| **Eighteenth Layer: second protective layer** | |
| Colloidal silver | as silver 0.10 mg |
| Fine grain silver iodobromide emulsion (average grain size: 0.06 μm, silver iodide content: 1 mol %) | as silver 0.10 g |
| Gelatin | 0.70 g |
| Ultraviolet absorbent U-1 | 0.06 g |
| Ultraviolet absorbent U-2 | 0.02 g |
| Ultraviolet absorbent U-5 | 0.12 g |
| High Boiling Point Organic Solvent Oil-2 | 0.07 g |
| **Nineteenth Layer: third protective layer** | |
| Gelatin | 1.40 g |
| Polymethyl methacrylate (average particle diameter: 1.5 μm) | 5.0 mg |
| 4:6 Copolymer of methyl methacrylate and acrylic acid (average particle diameter: 1.5 μm) | 0.10 g |
| Silicone oil | 0.030 g |

Photographic silver halide emulsions used are shown in Table 11.

TABLE 11

Light-Sensitive Emulsions used in Sample 201

| Layer | Emulsion | Coated Silver Amount ($g/m^2$) | Average Aspect Ratio of All Grains | Projected Area Diameter (circle-corresponding) Average Diameter (μm) | Projected Area Diameter (circle-corresponding) Coefficient of Variation (%) | AgI Content Average (mol %) | AgI Content Coefficient of Variation (%) | Property of Grain |
|---|---|---|---|---|---|---|---|---|
| Low-sensitivity | A | 0.16 | 1.0 | 0.24 | 13 | 3.5 | 55 | tetradecahedral |
| red-sensitive | B | 0.34 | 1.0 | 0.25 | 10 | 3.6 | 50 | tetradecahedral |
| emulsion layer | C | 0.19 | 1.0 | 0.28 | 10 | 3.3 | 20 | cubic |
| Medium-sensitivity red-sensitive emulsion layer | D | 0.50 | 1.0 | 0.43 | 18 | 2.6 | 50 | tetradecahedral |
| High-sensitivity red-sensitive emulsion layer | E | 0.50 | 2.8 | 0.85 | 8 | 1.6 | 15 | tabular |
| Low-sensitivity | F | 0.24 | 1.0 | 0.18 | 15 | 4.0 | 15 | cubic |
| green-sensitive | G | 0.41 | 1.0 | 0.24 | 11 | 4.0 | 50 | cubic |
| emulsion layer | H | 0.30 | 1.0 | 0.37 | 9 | 3.9 | 20 | cubic |
| Medium-sensitivity | I | 0.22 | 1.0 | 0.37 | 9 | 3.5 | 20 | cubic |
| green-sensitive emulsion layer | J | 0.28 | 1.0 | 0.52 | 9 | 3.2 | 25 | |
| High-sensitivity green-sensitive emulsion layer | K | 0.44 | 3.0 | 1.20 | 25 | 1.6 | 65 | cubic |
| Low-sensitivity | L | 0.17 | 3.0 | 0.49 | 12 | 4.7 | 15 | tabular |
| blue-sensitive | M | 0.04 | 4.5 | 0.65 | 8 | 4.7 | 20 | tabular |
| emulsion layer | N | 0.22 | 7.5 | 1.10 | 10 | 4.7 | 35 | tabular |
| Medium-sensitivity | O | 0.08 | 4.1 | 0.93 | 18 | 2.0 | 35 | tabular |
| blue-sensitive emulsion layer | P | 0.08 | 8.0 | 1.15 | 15 | 2.5 | 30 | tabular |
| High-sensitivity | Q | 0.21 | 3.0 | 1.52 | 25 | 1.2 | 65 | tabular |
| blue-sensitive emulsion layer | R | 0.26 | 10.0 | 2.88 | 13 | 1.2 | 20 | tabular |

| Layer | Emulsion | Occupation Ratio of (111) Face on Surface | Kind and Addition Amount of Sensitizing Dye (mg/Ag-mol) Kind | Amount | Kind | Amount | Kind | Amount | Kind | Amount |
|---|---|---|---|---|---|---|---|---|---|---|
| Low-sensitivity | A | 45 | S-1 | 250 | S-4 | 25 | — | — | — | — |
| red-sensitive | B | 35 | S-2 | 381 | S-4 | 20 | — | — | — | — |
| emulsion layer | C | 0 | S-2 | 264 | S-3 | 41 | S-4 | 14 | | |
| Medium-sensitivity red-sensitive emulsion layer | D | 50 | S-1 | 267 | S-4 | 105 | — | — | — | — |
| High-sensitivity red-sensitive emulsion layer | E | 99 | S-1 | 66 | S-2 | 240 | S-3 | 22 | S-4 | 1 |
| Low-sensitivity | F | 2 | S-7 | 544 | S-9 | 128 | — | — | — | — |
| green-sensitive | G | 1 | S-7 | 422 | S-9 | 122 | — | — | — | — |
| emulsion layer | H | 0 | S-7 | 479 | S-9 | 86 | — | — | — | — |
| Medium-sensitivity | I | 0 | S-5 | 479 | S-6 | 86 | — | — | — | — |
| green-sensitive emulsion layer | J | 5 | S-5 | 273 | S-8 | 55 | S-10 | 28 | — | — |
| High-sensitivity green-sensitive emulsion layer | K | 98 | S-7 | 213 | S-9 | 71 | S-10 | 33 | — | — |
| Low-sensitivity | L | 55 | S-12 | 185 | S-11 | 42 | S-13 | 42 | — | — |
| blue-sensitive | M | 50 | S-12 | 170 | S-11 | 38 | S-13 | 38 | — | — |
| emulsion layer | N | 45 | S-12 | 119 | S-11 | 27 | S-13 | 27 | — | — |
| Medium-sensitivity | O | 98 | S-12 | 260 | S-11 | 25 | S-13 | 24 | — | — |
| blue-sensitive emulsion layer | P | 99 | S-12 | 207 | S-11 | 20 | S-13 | 20 | — | — |
| High-sensitivity | Q | 99 | S-12 | 187 | S-11 | 18 | S-13 | 18 | — | — |
| blue-sensitive emulsion layer | R | 99 | S-12 | 173 | S-11 | 11 | S-13 | 11 | — | — |

Note 1)
The emulsions all are a core/shell type emulsion having a high iodide phase inside and each is subjected to gold/sulfur/selenium sensitization or gold/sulfur sensitization.
Note 2)
Compound F-1, F-3, F-7, F-8, F-9 or F10 was appropriately added to each of the emulsions.
Note 3)
The occupation ratio of (111) face on the surface was determined by method.

In addition to the above-described compositions, Additives F-1 to F-8, Surface Active Agents W-1 to W-6 and Gelatin Hardening Agent H-1 were added.

Further, phenol, 1,2-benzisothiazoline-3-one, 2-phenoxyethanol, phenetyl alcohol and butyl p-benzoate were added as an antiseptic and an antimold.

The swelling ratio (ratio of swollen film thickness to dry film thickness) of this sample was measured and found to be 1.8.

C-1

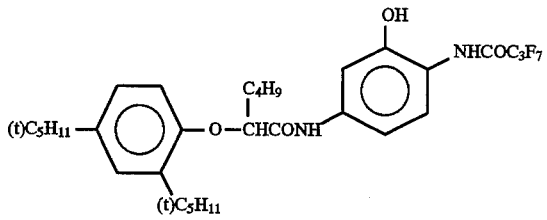

C-2

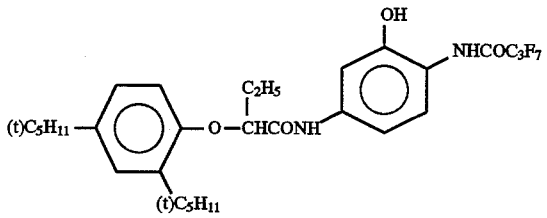

C-3

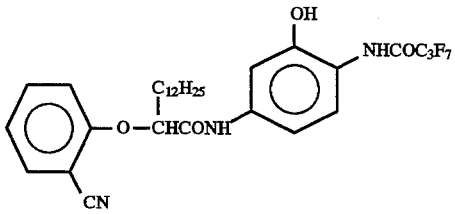

C-4

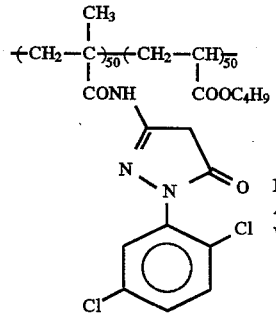

Numerals are by wt %.
Average molecular weight:
about 25,000

C-5

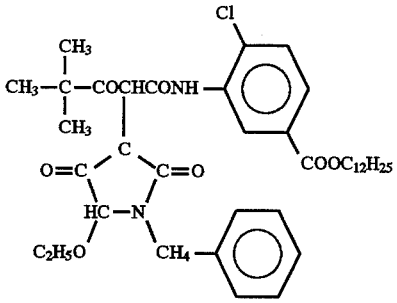

-continued
C-6
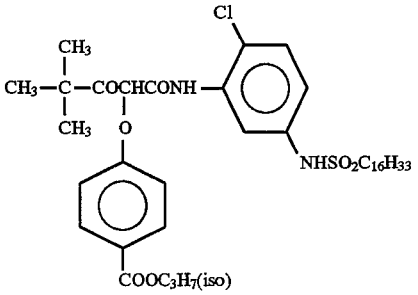
C-7
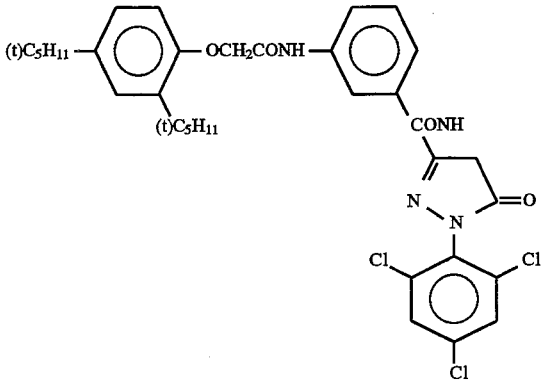
C-8
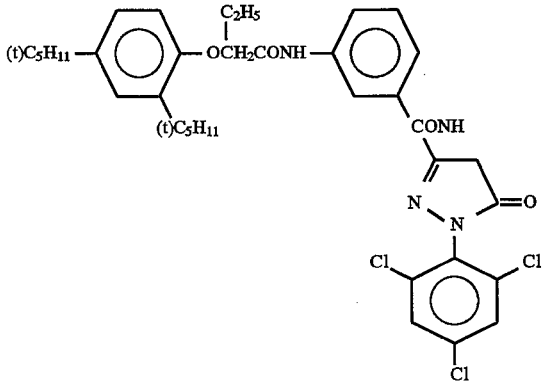
C-9
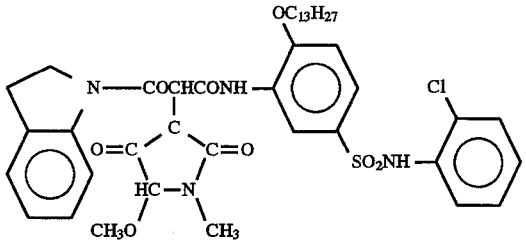
Dibutyl phthalate — Oil-1
Dicresyl phosphate — Oil-2
Oil-3
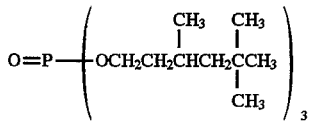

-continued
C-10
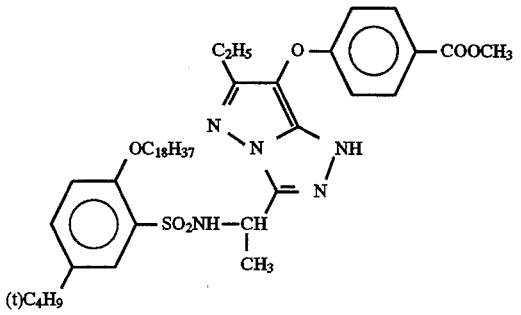
C-11
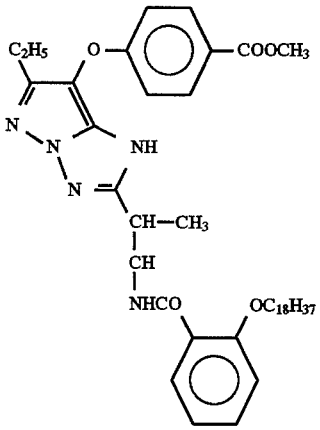
U-1
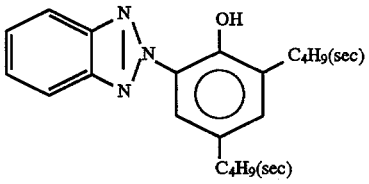
U-2
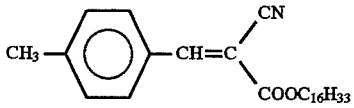
U-3
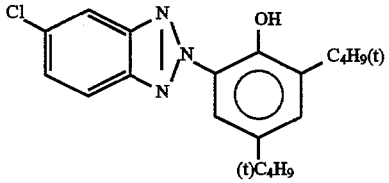
U-4
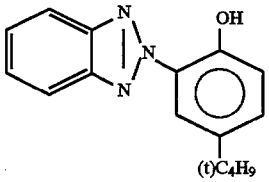
U-5
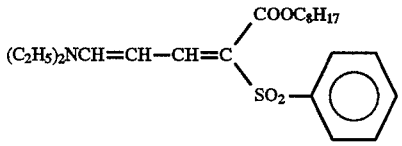

-continued
Cpd-A
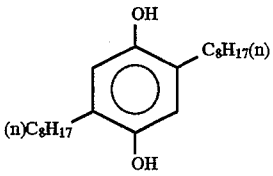
Cpd-B
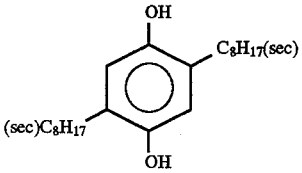
Cpd-C
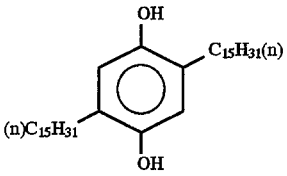
Cpd-D
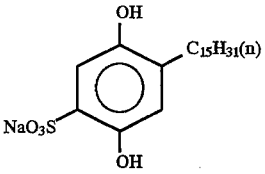
Cpd-E
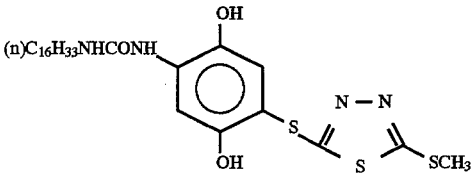
Cpd-F
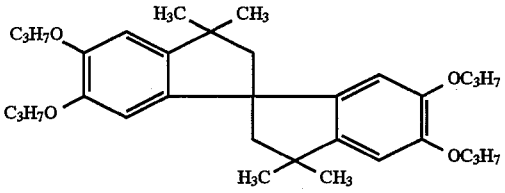
Cpd-G
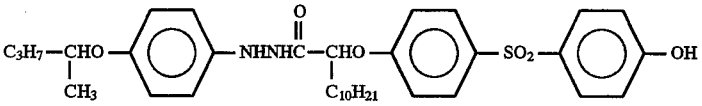
Cpd-H
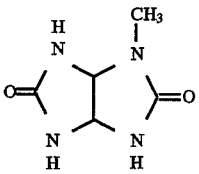
D-1
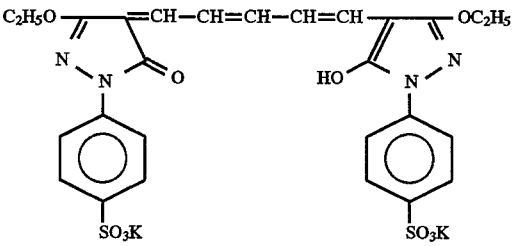

-continued
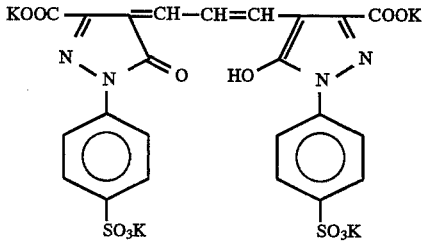
D-2
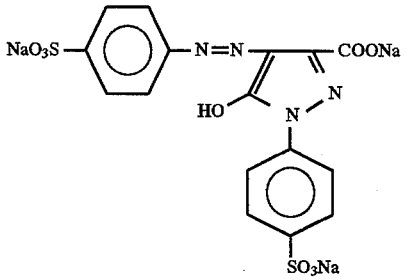
D-3
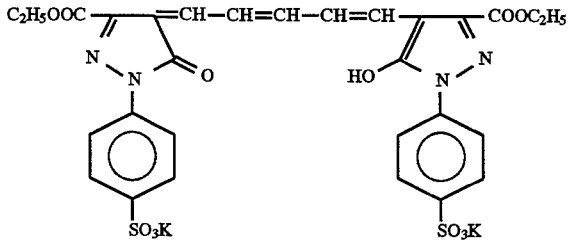
D-4
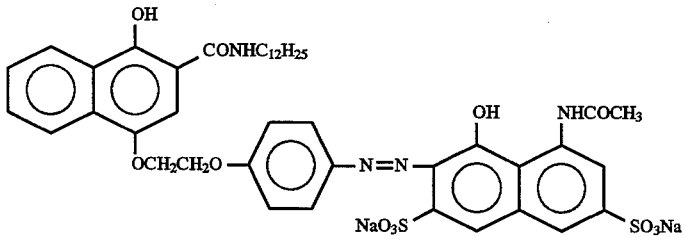
D-5
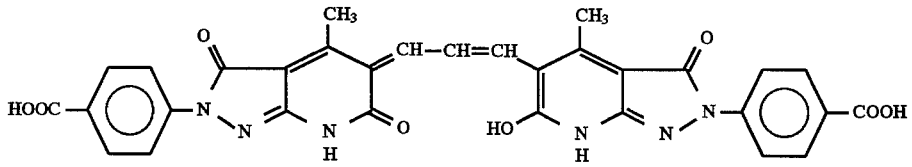
E-1
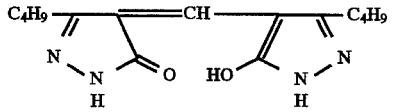
E-2
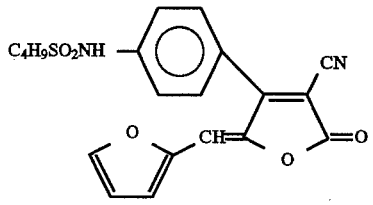
E-3

-continued
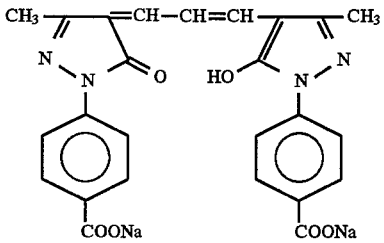
E-4
$C_8F_{17}SO_2N(C_3H_7)CH_2COOK$
W-2
$NaO_3S-CH(CH_2COOCH_2CH(C_2H_5)C_4H_9)COOCH_2CH(C_2H_5)C_4H_9$
W-3
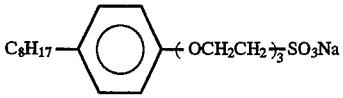
W-4
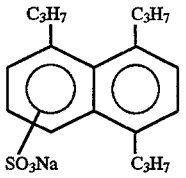
W-5
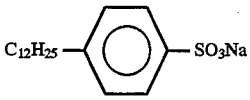
W-6
$-(CH_2-CH(CONHC_4H_9(t))-)_n-$
P-1
$-(CH_2-CH(COOC_4H_9)-)_n-$
M-1
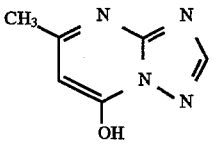
F-1
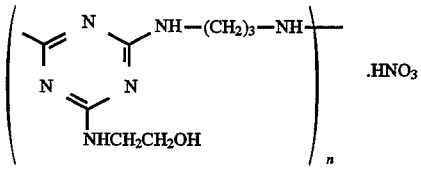
F-2
(n = 3 ~ 4)
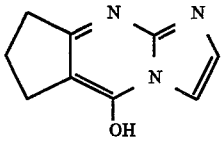
F-3

-continued
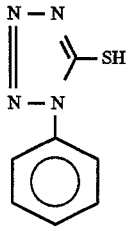
F-4
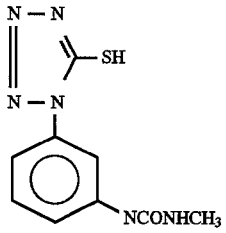
F-5
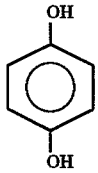
F-6
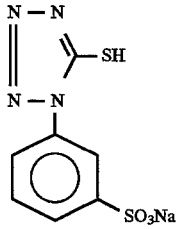
F-7
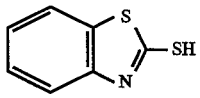
F-8
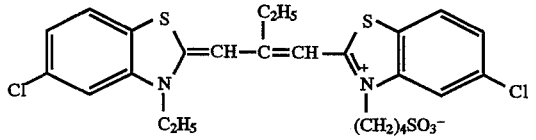
S-1
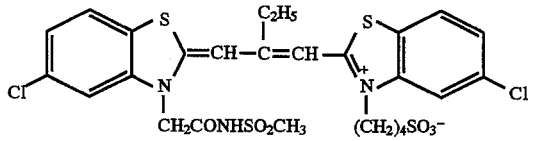
S-2
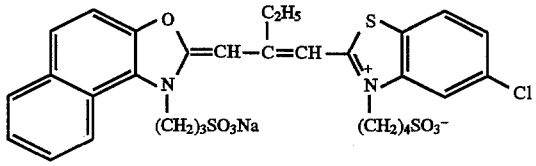
S-3

-continued
S-4
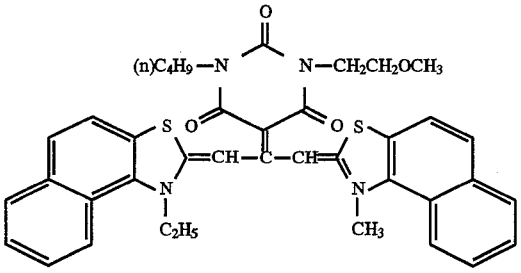
S-5
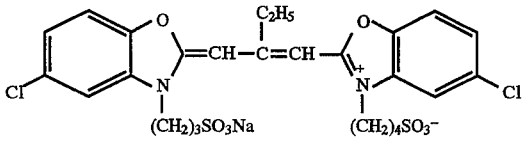
S-6
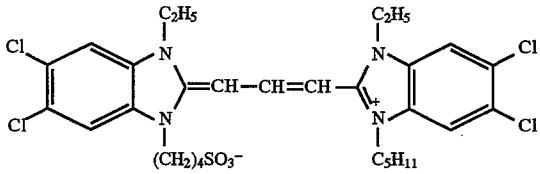
S-7
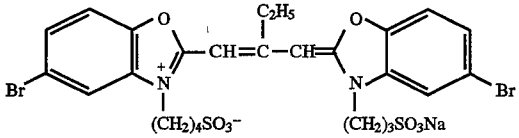
S-8
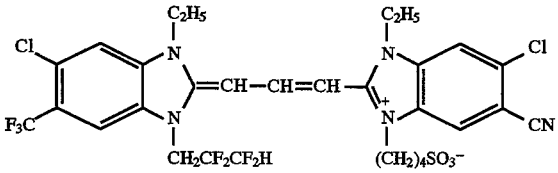
S-9
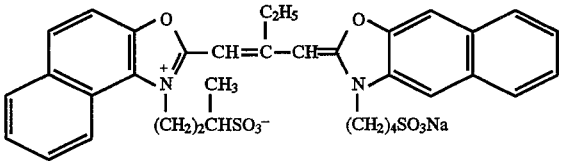
S-10
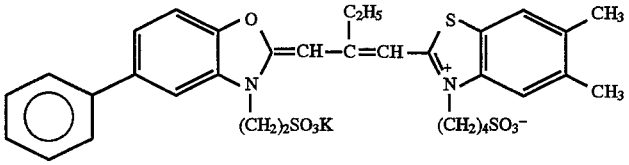
S-11
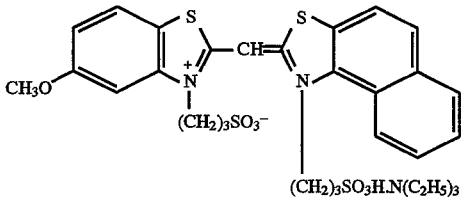
S-12
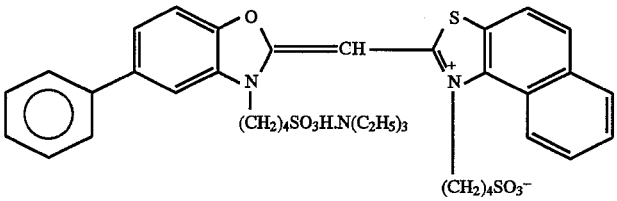

-continued

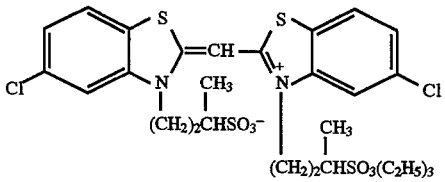

S-13

(2) Preparation of Samples 202 to 257

Samples 202 to 215, Samples 216 to 228, Samples 229 to 249 and Samples 250 to 258 were prepared in the same manner as Sample 201 except for replacing Emulsion E added to the sixth layer by Emulsions Em-1 to Em-14, replacing Emulsion H added to the ninth layer by Emulsions Em-15 to Em-18 and Em-42 to Em-50, replacing Emulsion K added to the eleventh layer by Emulsions Em-19 to Em-31 and Em-51 to Em-58 and replacing Emulsion Q added to the sixteenth layer by Emulsions Em-32 to Em-41, respectively.

(3) Evaluation of Samples (a) Sensitivity

Each of Samples 201 to 258 was wedgewise exposed at 2,000 lux for 1/50 second using a white color source having a color temperature of 4,800 K. and developed through the processing described below. Thereafter, the sensitivity was measured and shown by a relative value to the reciprocal of a relative exposure amount giving a cyan density of 2.0 for Samples 202 to 215, a magenta density of 1.0 for Samples 216 to 228, a yellow density of 2.5 for Samples 229 to 248 and a magenta density of 2.0 for Samples 242 to 258.

(b) Incubation durability

One part of each sample was stored in a freezer and another part was stored at 50° C. and 55% for 7 days. They were taken out, exposed and processed and a sensitivity difference therebetween was measured. It shows that the smaller the sensitivity difference, the superior the storage stability.

(c) Reciprocity law failure

Each sample was exposed for 1/100 second and 10 seconds with the same exposure amount and the sensitivity difference therebetween was measured. It shows that the smaller the sensitivity difference, the superior the reciprocity law failure property.

Processing Step and Processing Solution in Standard Development:

| Processing Step | Time (min) | Temperature (°C.) | Tank Volume (l) | Replenishing Amount (ml/m2) |
|---|---|---|---|---|
| First development | 6 | 38 | 12 | 2,200 |
| Water washing | 2 | 38 | 4 | 7,500 |
| Reversal | 2 | 38 | 4 | 1,100 |
| Color development | 6 | 38 | 12 | 2,200 |
| Pre-bleaching | 2 | 38 | 4 | 1,100 |
| Bleaching | 6 | 38 | 12 | 220 |
| Fixing | 4 | 38 | 8 | 1,100 |
| Water washing | 4 | 38 | 8 | 7,500 |
| Final rinsing | 1 | 25 | 2 | 1,100 |

Each processing solution had the following composition.

| First Developer: | Tank Solution (g) | Replenisher (g) |
|---|---|---|
| Pentasodium nitrilo-N,N,N-trimethylenephosphonate | 1.5 | 1.5 |
| Pentasodium diethylenetriamine-pentaacetate | 2.0 | 2.0 |
| Sodium sulfite | 30 | 30 |
| Potassium hydroquinone. monophosphonate | 20 | 20 |
| Potassium carbonate | 15 | 20 |
| Potassium bicarbonate | 12 | 15 |
| 1-Phenyl-4-methyl-4-hydroxy-methyl-3-pyrazolidone | 1.5 | 2.0 |
| Potassium bromide | 2.5 | 1.4 |
| Potassium thiocyanate | 1.2 | 1.2 |
| Potassium iodide | 2.0 mg | — |
| Diethylene glycol | 13 | 15 |
| Water to make | 1,000 ml | 1,000 ml |
| pH | 9.60 | 9.60 |

The pH was adjusted with sulfuric acid or potassium hydroxide.

| Reversal Solution: | Tank Solution (g) | Replenisher (g) |
|---|---|---|
| Pentasodium nitrilo-N,N,N-trimethylenephosphonate | 3.0 | same as tank solution |
| Stannous chloride dihydrate | 1.0 | |
| p-Aminophenol | 0.1 | |
| Sodium hydroxide | 8 | |
| Glacial acetic acid | 15 ml | |
| Water to make | 1,000 ml | |
| pH | 6.00 | |

The pH was adjusted by acetic acid or sodium hydroxide.

| Color Developer | Tank Solution (g) | Replenisher (g) |
|---|---|---|
| Pentasodium nitrilo-N,N,N-trimethylenephosphonate | 2.0 | 2.0 |
| Sodium sulfite | 7.0 | 7.0 |
| Trisodium phosphate dodecahydrate | 36 | 36 |
| Potassium bromide | 1.0 | — |
| Potassium iodide | 90 mg | — |
| Sodium hydroxide | 3.0 | 3.0 |
| Citrazinic acid | 1.5 | 1.5 |
| N-Ethyl-N-(β-methanesulfonamidoethyl)-3-methyl-4-aminoaniline.3/2 sulfuric acid monohydrate | 11 | 11 |

-continued

| Color Developer | Tank Solution (g) | Replenisher (g) |
|---|---|---|
| 3,6-Dithiaoctane-1,8-diol | 1.0 | 1.0 |
| Water to make | 1,000 ml | 1,000 ml |
| pH | 11.80 | 12.00 |

The pH was adjusted with sulfuric acid or potassium hydroxide.

| Pre-Bleaching Solution: | Tank Solution (g) | Replenisher (g) |
|---|---|---|
| Disodium ethylenediamine-tetraacetate dihydrate | 8.0 | 8.0 |
| Sodium sulfite | 6.0 | 8.0 |
| 1-Thioglycerol | 0.4 | 0.4 |
| Formaldehyde sodium bisulfite adduct | 30 | 35 |
| Water to make | 1,000 ml | 1,000 ml |
| pH | 6.30 | 6.10 |

The pH was adjusted with acetic acid or sodium hydroxide.

| Bleaching Solution: | Tank Solution (g) | Replenisher (g) |
|---|---|---|
| Disodium ethylenediamine-tetraacetate dihydrate | 2.0 | 4.0 |
| Ammonium ethylenediamine-tetraacetato ferrate dihydrate | 120 | 240 |
| Potassium bromide | 100 | 200 |
| Ammonium nitrate | 10 | 20 |
| Water to make | 1,000 ml | 1,000 ml |
| pH | 5.70 | 5.50 |

The pH was adjusted with nitric acid or sodium hydroxide.

| Fixing Solution: | Tank Solution (g) | Replenisher (g) |
|---|---|---|
| Ammonium thiosulfate | 80 | same as tank solution |
| Sodium sulfite | 5.0 | |
| Sodium bisulfite | 5.0 | |
| Water to make | 1,000 ml | |
| pH | 6.60 | |

The pH was adjusted with acetic acid or aqueous ammonia.

| Final Rinsing Solution: | Tank Solution (g) | Replenisher (g) |
|---|---|---|
| 1,2-Benzoisothiazoline-3-one | 0.02 | 0.03 |
| Polyoxyethylene-p-monononyl-phenyl ether (average polymerization degree: 10) | 0.3 | 0.3 |
| Polymaleic acid (average molecular weight: 2,000) | 0.1 | 0.15 |
| Water to make | 1,000 ml | 1,000 ml |
| pH | 7.0 | 7.0 |

Similarly to the results of Samples 101 to 158, samples containing the emulsion of the present invention showed high sensitivity, good incubation durability and small reciprocity law failure.

The silver halide emulsion and the silver halide photographic material of the present invention have features such that the sensitivity is high, incubation durability is good and the reciprocity law failure is small.

While the invention has been described in detail and with reference to specific embodiments thereof, it will be apparent to one skilled in the art that various changes and modifications can be made therein without departing from the spirit and scope thereof.

What is claimed is:

1. A method for producing a silver halide emulsion, said method comprising:

adding silver nitrate solution to a halogen salt solution to form an emulsion of silver halide grains; and doping a non-labile selenium compound in an amount, in terms of selenium added, of from $1.0\times10^{-8}$ to $1.0\times10^{-6}$ mol per a unit surface area of 1 $m^2$ of said silver halide grains at the time when from 10 to 49% of the total silver amount used for the formation of said emulsion of silver halide grains is added.

2. A method for producing a silver halide emulsion as claimed in claim 1, wherein said silver halide emulsion contains a nucleophilic agent represented by formula (I) in an amount of from $1.0\times10^{-8}$ to $5.0\times10^{-6}$ mol per a unit surface area of 1 $m^2$ of said silver halide grains:

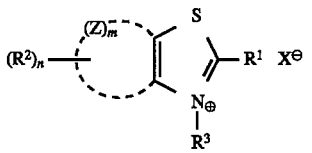

(I)

wherein $R^1$ represents a hydrogen atom or an alkyl group having from 1 to 6 carbon atoms which may be substituted, m represents 0 or 1, when m is 1, Z represents a condensed benzene ring and $R^2$ substitutes to the ring and when m is 0, $R^2$ substitutes to the 4- or 5-position of the thiazolium ring, $R^2$ represents a hydrogen atom, an alkyl group which has 1 to 6 carbon atoms and which may be substituted, an alkenyl group which has 1 to 6 carbon atoms and which may be substituted, an alkynyl group which has 1 to 6 carbon atoms and which may be substituted, an alkoxy group which has 1 to 6 carbon atoms and which may be substituted, or an electron-withdrawing group, when n is 2 or more, a plurality of $R^2$ groups may be the same or different or the $R^2$ groups may be combined with each other to form a condensed ring, $R^3$ represents a hydrogen atom or an alkyl, alkenyl, alkynyl or aralkyl group which may be substituted, $X^-$ represents an anion, and n represents an integer of from 0 to 3, and said nucleophilic agent may be a compound where the thiazolium ring for formula (I) is opened.

3. A method for producing a silver halide emulsion as claimed in claim 1, wherein a thiocyanate ion is doped before the completion of the formation of said emulsion of silver halide grains.

4. A method for producing a silver halide emulsion as claimed in claim 1, wherein iridium is doped in an amount of from $3.4\times10^{-10}$ to $1.0\times10^{-9}$ mol per a unit surface area of 1 $m^2$ of said silver halide grains, at the time when from 10 to 50% of the total silver amount used in the formation of said emulsion of silver halide grains is added.

5. A method for producing a silver halide emulsion as claimed in claim 1, wherein said emulsion of silver halide grains comprises a tabular grain having an aspect ratio of from 2 to 100.

6. A method for producing a silver halide emulsion as claimed in claim 1, wherein said method further comprises subjecting said emulsion of silver halide grains to reduction sensitization.

7. A method for producing a silver halide emulsion as claimed in claim 1, wherein said silver halide emulsion is a silver iodobromide emulsion.

8. A method for producing a silver halide emulsion as claimed in claim 1, wherein said silver halide emulsion is a monodisperse emulsion.

* * * * *